US011183008B2

(12) United States Patent
El Kai

(10) Patent No.: US 11,183,008 B2
(45) Date of Patent: Nov. 23, 2021

(54) SYSTEM, DEVICES AND METHODS FOR PLAYING REAL CASINO GAMES USING ACCESSORIES OUTSIDE A LAND-BASED CASINO

(71) Applicant: Bachir Georges El Kai, Kesserwan (LB)

(72) Inventor: Bachir Georges El Kai, Kesserwan (LB)

( * ) Notice: Subject to any disclaimer, the term of this patent is extended or adjusted under 35 U.S.C. 154(b) by 119 days.

(21) Appl. No.: 16/268,620

(22) Filed: Feb. 6, 2019

(65) Prior Publication Data

US 2019/0251781 A1 Aug. 15, 2019

Related U.S. Application Data

(60) Provisional application No. 62/628,398, filed on Feb. 9, 2018.

(51) Int. Cl.
*G07F 17/32* (2006.01)

(52) U.S. Cl.
CPC ..... *G07F 17/3225* (2013.01); *G07F 17/322* (2013.01); *G07F 17/3209* (2013.01); *G07F 17/3213* (2013.01); *G07F 17/3288* (2013.01); *G07F 17/3293* (2013.01)

(58) Field of Classification Search
CPC ..... G07F 17/3225; G07F 17/3209; G07F 17/3213; G07F 17/322; G07F 17/3288; G07F 17/3293
See application file for complete search history.

(56) References Cited

U.S. PATENT DOCUMENTS 6,001,016 A * 12/1999 Walker ..... G07F 17/32 463/20
6,011,016 A * 1/2000 Schmidt ..... A23L 33/15 514/23
6,361,437 B1 * 3/2002 Walker ..... G07F 17/32 463/23
7,066,815 B2 * 6/2006 Walker ..... G07F 17/32 463/23
7,083,517 B2 * 8/2006 Salerno ..... G06Q 50/34 463/29
7,341,517 B2 * 3/2008 Asher ..... G07F 17/3244 463/25
7,437,147 B1 * 10/2008 Luciano, Jr. ..... G07F 17/32 455/414.1

(Continued)

*Primary Examiner* — David L Lewis
*Assistant Examiner* — Matthew D Hoel

(57) ABSTRACT

The present invention discloses a device, a system and a method for providing a remote live wager-based gaming environment through playing on real/physical casino tables and using real casino chips/tokens that the player can touch and feel with his/her hands as well as opening and revealing bendable display devices that stimulates the playing cards to give the feeling of touching and feeling real cards in hand. A computing device is in communication with an online casino and works as an intermediate between the gaming device and the online casino. Gaming devices are in communication with the computing device and configured to enable a player to perform at least one gaming activity at a gaming field. The gaming devices comprises at least one display device, casino chips/tokens. A detector device is configured to detect and identify a gaming data of the at least one gaming activity.

21 Claims, 24 Drawing Sheets

(56) References Cited

U.S. PATENT DOCUMENTS 7,967,682 B2 * 6/2011 Huizinga ..... G07F 17/32 463/42
8,079,905 B2 * 12/2011 Nguyen ..... G07F 17/3206 463/29
8,308,574 B2 * 11/2012 Burke ..... G07F 17/3269 463/42
8,764,572 B2 * 7/2014 Nguyen ..... G07F 17/32 463/44
8,840,464 B1 * 9/2014 Brunell ..... G07F 17/3204 463/29
8,870,647 B2 * 10/2014 Huizinga ..... G07F 17/32 463/29
8,961,318 B2 * 2/2015 Liber ..... G07F 17/3218 463/42
9,005,011 B2 * 4/2015 Gagner ..... G07F 17/3262 463/25
9,262,885 B2 * 2/2016 Moore ..... A63F 3/00157
9,390,592 B2 * 7/2016 Chun ..... G07F 17/3293
9,659,433 B2 * 5/2017 Chun ..... G07F 17/3244
9,694,272 B2 * 7/2017 Moore ..... A63F 3/00157
9,786,123 B2 * 10/2017 Huizinga ..... G07F 17/3223
9,792,761 B2 * 10/2017 Gagner ..... G07F 17/32
10,013,848 B2 * 7/2018 Chun ..... G07F 17/322
10,201,745 B2 * 2/2019 Moore ..... G07F 17/322
10,360,768 B2 * 7/2019 Saccoccio ..... G06Q 50/34
10,643,429 B2 * 5/2020 Moore ..... G06K 7/10009
10,819,706 B2 * 10/2020 Russell ..... H04W 12/50
10,967,246 B2 * 4/2021 Moore ..... A63F 9/24
11,094,161 B2 * 8/2021 Cleveland ..... G07F 17/3276
11,132,862 * 9/2021 Cleveland ..... G06Q 20/3276
2002/0032049 A1 * 3/2002 Walker ..... G07F 17/323 463/16
2002/0111213 A1 * 8/2002 McEntee ..... G07F 17/32 463/42
2003/0022718 A1 * 1/2003 Salerno ..... G06Q 50/34 463/42
2005/0085291 A1 * 4/2005 Lindo ..... G07F 17/3244 463/25
2005/0085293 A1 * 4/2005 Lindo ..... G07F 17/3223 463/25
2005/0159212 A1 * 7/2005 Romney ..... G07F 17/3288 463/25
2006/0223613 A1 * 10/2006 Walker ..... G07F 17/3239 463/16
2006/0223636 A1 * 10/2006 Walker ..... G07F 17/323 463/40
2007/0243927 A1 * 10/2007 Soltys ..... G07F 17/32 463/25
2007/0243935 A1 * 10/2007 Huizinga ..... G07F 17/32 463/42
2008/0108426 A1 * 5/2008 Nguyen ..... G07F 17/32 463/25
2010/0210353 A1 * 8/2010 Gagner ..... G07F 17/32 463/25
2011/0224002 A1 * 9/2011 Burke ..... G07F 17/32 463/42
2012/0115584 A1 * 5/2012 Nguyen ..... G07F 17/3206 463/25
2012/0252564 A1 * 10/2012 Moore ..... G07F 17/3237 463/25
2014/0080603 A1 * 3/2014 Gagner ..... G07F 17/32 463/31
2014/0094234 A1 * 4/2014 Chun ..... G07F 17/34 463/11
2015/0045117 A1 * 2/2015 Soltys ..... G07F 17/3223 463/25
2016/0121201 A1 * 5/2016 Moore ..... A63F 1/06 463/11
2016/0321860 A1 * 11/2016 Chun ..... G07F 17/3293
2017/0236369 A1 * 8/2017 Chun ..... G07F 17/3293 463/13
2017/0259166 A1 * 9/2017 Moore ..... G07F 17/3237
2018/0122187 A1 * 5/2018 Moore ..... G07F 17/3248
2019/0026991 A1 * 1/2019 Torres ..... G07F 17/3276
2019/0066450 A1 * 2/2019 Saccoccio ..... H04W 4/70
2019/0168110 A1 * 6/2019 Moore ..... A63F 9/24
2019/0333340 A1 * 10/2019 Saccoccio ..... G06Q 20/3224
2020/0014683 A1 * 1/2020 Russell ..... G07F 17/329
2020/0111279 A1 * 4/2020 Cleveland ..... G07F 17/3225
2020/0111280 A1 * 4/2020 Cleveland ..... G07F 17/3223
2020/0265677 A1 * 8/2020 Moore ..... A63F 1/18
2021/0295636 A1 * 9/2021 Cleveland ..... G06Q 20/3672

* cited by examiner

SYSTEM, DEVICES AND METHODS FOR PLAYING REAL CASINO GAMES USING ACCESSORIES OUTSIDE A LAND-BASED CASINO

CROSS-REFERENCE TO RELATED APPLICATION

The present utility patent application claims the priority benefit OF U.S. provisional patent application Ser. No. 62/628,398 filed on Feb. 9, 2018,", the entirety of which is incorporated herein by reference for all purposes.

BACKGROUND OF THE INVENTION

A. Technical Field

The present invention is related to systems and a devices that are used as casino table games and table games' layouts that enable players to play on real casino tables like Blackjack, Roulette, Texas Hold'em Poker, Caribbean Stud Poker, Laysix (reference: www.laysix.com) and many other casino table games for real money from their own homes or any other place outside a physical casino using a connection to power supply, to the internet and to an online casino.

The related invention enables players to play online casino games through tables and/or/layouts and/or electric and/or electronic and/or other components that enhance their gaming experience from their own homes or any other places they desire using this invention without the need to be physically present inside a physical or brick-and-mortar casino and without the need for dealers to operate the games, hands, rolls. This can be achieved by connecting the devices subject of this invention to suitable electrical power supplies and suitable internet connections and playing using real (physical) chips in hand as well as different controls and functions as well as bendable physical display screens to substitute for the touch and feel of playing cards.

B. Description of Related Art

Online casinos have been a growing industry since the technological advancement has taken place. Playing online casino table games is a pastime and an entertaining activity for players, but currently players miss the touch and feel generated from playing inside physical casinos when they play online. This invention solves this particular problem. It is directed to those players who wish to play casino table games for real money from home and/or from other places outside a physical casino on real tables that may or may not be connected directly to an online casino with or without live online dealers.

SUMMARY OF THE INVENTION

It is an object of the present invention to provide devices, systems and methods for providing a live wager-based gaming environment that enables a user to play on real casino table games outside a physical casino.

It is another object of the present invention to provide devices, systems and methods that allow players outside land-based casinos i.e. (in their homes or other places) to play on real tables, using real chips and cards that they can touch and feel with their hands.

It is another object of the present invention to provide the touch and feel senses to the online gaming. Touch and feel are important factors of playing casino games and usually playing online prevents these senses to be utilized to the fullest because the players interact fully with a computer mouse and screen (touch or no touch). Touching real chips and revealing cards in a physical manner (revealing them slowly by bending them) is an important factor for the excitement and pleasure that players feel when they play casino table games.

It is yet another object of the present invention to eliminate the stress and pressure as well as the negative effect of crowd for a player while also touching and feeling chips and cards even from home.

It is yet another object of the present invention to eliminate the difficulty of learning casino games for novice players and this can cause them embarrassment when placing a bet in an inappropriate position or not knowing the basic strategy of playing certain games, and sometimes not knowing how to play can cause harassment from other persons or players existing in the same casino as well as the possibility of being scammed by those other persons or players with money by asking these players to play particular bets or take specific decisions and then ask them for a share if they win.

In one embodiment, the system is configured to provide a live wager-based gaming environment. In one embodiment, the system comprises a computing device, one or more gaming and display devices, and a detector device. In one embodiment, the computing device comprising one or more processor and generate at least one gaming field. In one embodiment, the computing device is configured to receive one or more user selections including a selection for generating the at least one gaming field. In one embodiment, the computing device is in communication with a gaming server and a database, and wherein the computing device is configured to function as a center brain that operates, manages and complement other connected devices to enable playing on real and physical casino table games remotely without the need for any operator or dealer.

In one embodiment, the one or more gaming devices are in communication with the computing device. The gaming device is configured to enable a player to perform at least one gaming activity at the gaming field. In one embodiment, the gaming activity is a wager-based gaming activity. In some embodiments, the gaming activity comprises at least any one of casino table games such as, but not limited to, roulette, blackjack, Texas hold'em poker, Caribbean stud poker, Russian poker, pai gow poker, Lasix and war.

In one embodiment, the gaming devices are configured to simulate a physical casino table game layout and comprises one or more computing devices and/or display devices and tokens. The display device is at least one of a flexible and/or bendable screen and/or a non-flexible and non-bendable screen and/or the same computing device and/or a tablet. In one embodiment, the display device is configured to function as a physical playing card for displaying the cards generated by a computer system or drawn by an online live dealer and could be linked or not linked to the online casino gaming server.

In one embodiment, the detector device in communication with the gaming devices. The detector device is configured to detect and identify gaming data and details of the at least one gaming activity. The computing device is configured to collect the gaming data and display a response respective to the gaming data. In one embodiment, the gaming data comprises position, value and number of tokens placed for wager and value of the playing card. The detector device contains a minimum of 1 Bluetooth® low energy (BLE) beacon, configured for detecting the position of the token placed on the simulated casino table. In one embodiment, the detector device comprises of 1 or more digital scales connected to a printed circuit board (PCB) and to a computing device, encoded with a weighing value retained by the digital scales and then decoded by the PCB, by converting the machine-readable medium into computer readable value and then transforming the data generated by these scales into data that can used by the computer in the performance of the whole system.

In one embodiment, the detector device is a position detecting means. In one embodiment, the detector device comprises a minimum of a first BLE beacon and a second BLE. The first BLE beacon is configured with the wager bases of the layout table of the chosen gaming field and the second BLE beacon is configured with the wager tokens to be placed on a particular position of the layout table. In one embodiment, each first and second BLE beacons are encoded with information comprising specific codes, to be decoded and transferred to the computing device when the power is switched on and wherein the wager tokens are positioned proximate to the detector device on the layout table.

In one embodiment, the detector device further comprises a minimum of one light color sensor for detecting the position of the tokens positioned on the layout table. In one embodiment, the detector device is a minimum of 1RFID readers. The detector device is configured to read encoded tags, the reader being coupled to the layout table and the encoded tags coupled with the wagered tokens, the reader being able to transmit the encoded messages to the computing device for determining the position of each of the wager tokens on the layout table.

In one embodiment, the detector device contains a minimum of one laser sensor having an encoded unique code. The laser sensor with the encoded unique code is configured to measure the distances of the tokens that are positioned on top of it, and reporting the measured distances to the computing device. The computing device accepting the farthest reported distance and dividing the distance by the thickness of each of the tokens and reporting the number of tokens on the wager and the unique code of the sensor.

The detector device is a minimum of one smart 3D camera, coupled to the computing device through a PCB and encoded with specific instructions. In one embodiment, the 3D cameras capture images of the layout table and report the captured images to the computing device. Further, the computing device compares the reported images with the database of the token images and identifies the number and value of the token placed on each of the wagering options of the casino table layout. The images are captured every 0.1 seconds and reported to the system and the system updated real-time.

In one embodiment, a method of playing card games in real-time utilizing the system of the present invention is disclosed. The method includes but not limited to one or more of these steps. At one step, the system is plugged to a power supply. At another step, the player could install the online casino's game app. At another step, the player logs into his/her account and be prompted to enter his/her instructions. At another step, the entered playing instructions are received by the remote player. At another step, the request for wagers is transmitted to the remote player. At another step, the value of the token chosen by the player is detected utilizing the gaming devices. At another step, the real cards and tokens are displayed by one or more display devices for functioning as casino chips. At another step, the chosen value is announced and a wager is accepted from the remote player. At another step, the consent is received from the player for validating the wagers played. Further step, the result of the wages and game is announced or communicated to the remote player.

In one embodiment, a method of playing games utilizing the gaming devices of the present invention is disclosed. The method includes but not limited to one or more of these steps. At one step, the position of the real cards is identified by receiving the user selection on the screen by the system. At another step, the perimeter of the cards is highlighted and prompted the player to confirm the position of the cards inside the perimeter by the system. At another step, the identified frame position is sent in the form of pixel data of the cards in real time to the server. At another step, each if the cards rank pixels are separately checked by the system and compared with the card rank pixel database of the system. At another step, a code is allocated to each of the cards rank. At another step, the color pixels are checked by the system and compared it with the color pixels of the database of the system. At another step, the codes received, identified, and compared with that of the database of the system lead to the identification of Ranks and values of the player's cards. Further step, the player's cards are extracted from the database and each displayed on one of the external screens.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The embodiments herein will be better understood from the following detailed description with reference to the drawings, in which.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing descriptions. All changes that come within the meaning and range of equivalency of the claims are to be embraced within their scope.

Figure 1:
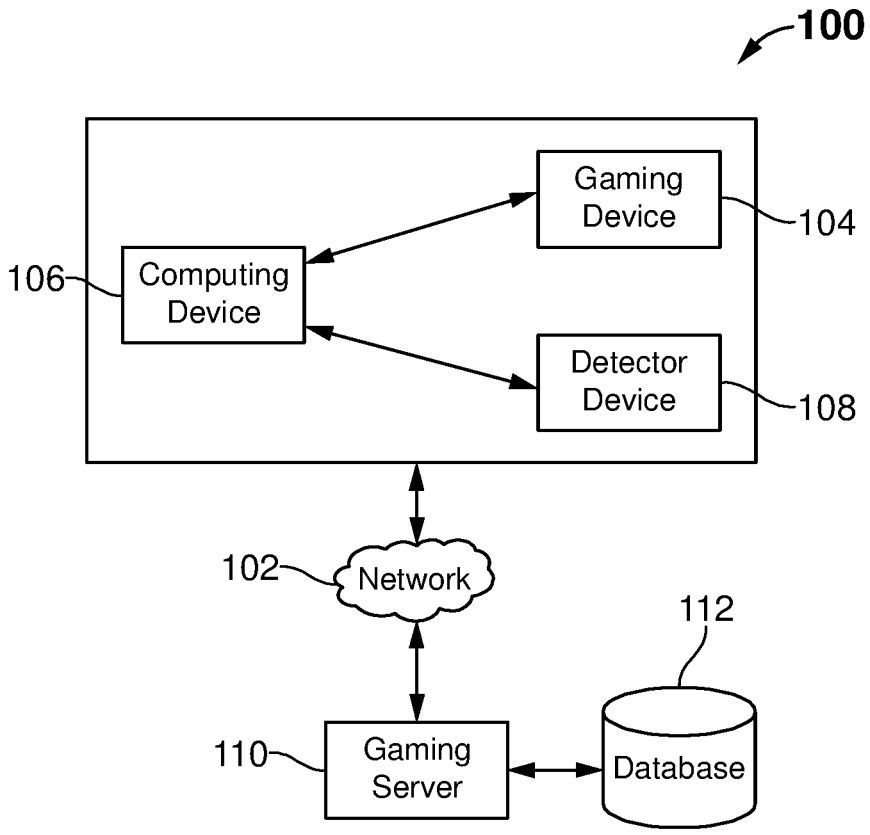
FIG. 1 exemplarily illustrates a block diagram of an environment implemented, according to one embodiment of the present invention.

The present invention provides a system and method for providing a live wager-based gaming environment. This environment enables a user to play on real casino table games outside a physical casino. This environment allows players outside land-based casinos i.e. (in their homes or other places) to play on real tables, using real chips and cards that they can touch and feel with their hands. FIG. 1 exemplarily illustrates a block diagram of an environment implemented, according to one embodiment of the present invention. The environment comprises a computing device 106, a gaming server 110, a database 112, one or more gaming devices 104 and one or more detector devices. The computing device 106 comprises one or more processor configured to generate at least one gaming field. The gaming device in communication with the computing device 106 is configured to enable the user to perform at least one gaming activity at the gaming field. The computing device 106 access the server 110 via a network 102. In an embodiment, the network 102 could be Wi-Fi network, WiMax network, and wireless local area network.

In one embodiment, the database 112 may be accessible by the gaming server 110. The database 112 may be integrated into the gaming server 110 or separate from it. In some embodiments, the database 112 resides in a connected server or in a cloud computing service. Regardless of location, the database 112 comprises a memory to store and organize certain data for use by the gaming server 110.

The detector device in communication with the gaming devices 104 configured to detect and identify a gaming data of the at least one gaming activity, wherein the computing device 106 is configured to collect the gaming data and display a response respective to the gaming data. In one embodiment, the computing device 106 is a tablet. In another embodiment, the computing device is at least one of a desktop, a laptop, a tablet, a mobile phone, and mobile and/or handheld electronic devices.

In one embodiment, the gaming devices 104 disposed at a table mimicking a casino table layout and components required for the live games. The detector devices are disposed at the betting areas of the casino table layout.

In one embodiment, the gaming device 104 comprises one or more display devices and tokens. The display device is configured to function as a physical playing card for displaying the cards generated by a computer system or drawn by an online live dealer and linked with the gaming server. In one embodiment, the display device is a flexible display screen. The flexible screen is coupled to a PCB that transforms the data through, but not limited to, USB protocol from the computer to the display screen. The tokens embedded with detector device 108 is configured to function as a casino chip/token.

In one embodiment, the token embedded with the RFID tag or a small integrated circuit IC that emits radio frequency. The token comprises memory to store the basic product code and other essential data required for identifying the token by a RFID reader. In one embodiment, the RFID reader is a UHF or SHF RFID reader. In another embodiment, the RFID reader is a network-connected device. The RFID reader comprises an antenna that sends power and receives the signals as commands to the tags. The reader device is an access point for RFID tagged items so that the tags data is made available to a software which processes these data. The reader devices are pre-programmed with a tag identifier and a unique serial number. The tag antenna is a collector of energy that channels it to the chip in order to turn it on. The reader's beam angle can be placed to capture certain tagged chips placed in a certain position on the table.

In another embodiment, the casino chip is embedded with at least one of a BLE beacons, PCB. In one embodiment, the detector device 108 comprises one or more 3D cameras that captures the scene from different angles and transmits to the computing device 106 to automatically draw the physical space and objects. By taking pictures of the objects (casino chips/tokens) from different angles and comparing the photos (or their pixels) to other photos in the database 112, the cameras can identify the positions of casino chips and the number of casino chips.

In another embodiment, the detector device 108 is a digital scale. In one embodiment, the digital scale is placed below the table layout top. The scales are configured to report weight data of the casino chips/tokens placed on each of the bets/scales on the table layout to a weight calculating module comprising set of program instructions. In one embodiment, the weight calculating module is in the computing device 106. In another embodiment, the weight calculating module is disposed separately from the computing device 106. The weight calculating module is connected to the computing device 106 through cable or wireless connection. The weight calculating module is configured to analyze the number of chips played on a specific area (betting area). Digital scales are disposed at each of the betting areas and each connected to a unique code in the weight calculating module. The weight calculating module is configured to identify the total bet value (or number of played chips) by dividing the total reported weight from each of the scales under the betting areas by the weight of one chip. The weight calculating module is configured to calculate how many chips played in a specific area, what is the value of the one chip and what is the total value of all the chips played in a specific area and then those chips (bets) are placed on the online casino game table layout as if they were played by using the mouse or by touching the screen In another embodiment, the detector device 108 contains load cells placed under the table layout for each of the possible bets. These load cells include overweight protection in their systems. The manner in which the loadcells are placed varies with the design of the layout but as an example and a standard description and while not limiting our options to this design, a matrix of electronic scales comprises loadcells and metal or plastic tops could be in square shapes. In an embodiment, the metal or plastic tops are the weighing platforms. In another embodiment, the metal or plastic tops could comprise round shape or any other shape. The scales comprise an edge of more or less of 1 mm to distinguish the different positions of the bets. When players place their bets on a certain position on the layout, each of the Scales weighs the load of the chips on top and report the load to the computing device 106 along with the code of the scale.

For example, the casino chip that is supplied with the layout weighs 8 grams and the bet "0" on the Roulette layout has a scale that is coded R000; when 1 chip is placed on the bet "0" the scale R000 would report in real-time the weight 8 grams and the code R000 to the computing device 106. The computing device 106 would match the code of the scale to the database and determines that this scale is under the "0" bet on Roulette. The computing device 106 divides the total reported weight from the scale by 8 grams and the result 1 chip will be identified, then the computer device would place 1 bet of predefined value (value predefined by the player before placing bets) on the online casino layout. If the reported weight is 16 grams, the computing device 106 would place 2 chips on "0" and if the reported weight is 24 grams, the system would place 3 chips on "0" etc.

In one embodiment, the gaming device comprises a maximum number of chips to be placed on the single bet (single scale), for example, 30 chips. The weight calculated by the detector device 108 may not be 100% accurate and some scales might report a weight with a +−0.5% or %, but the system is configured to justify the weight to the closest number of chips i.e. if the reported weight for 30 chips should be 240 grams (based on 8 grams chips) and if the variance is 1%+then the reported weight would be 242.4 grams; the system divides the number by 8 and gets the result of 30.3125 Chips. The system rounds the number to the closest complete number i.e. to 30 chips in this case (because the 0.3 is under less than 0.5. If the variance is 1%—, then the result of 30 chips would be 237.6 grams and if divided by 8 the result would be 29.7 chips and the system will identify that the bet has 30 chips since the system will round the 0.7 to 1

In one embodiment, the detector device 108 utilizes Bluetooth low energy to identify the position of the chips and the number of chips placed on each position. In this model a BLE beacon will be placed under the layout top of each of the bets and these would be connected to bet bases, these beacons will have specific codes for each of them and they are turned "ON" whenever the layout/device is connected to power supply. The casino chips/tokens would also contain beacons inside them with specific codes for each of them and they are designed in a way that are activated once they touch the table layout through positive and negative round or in other shapes metal conductors embedded inside them. When the Casino chips/tokens touch the table bet bases, their beacons get activated and both the table beacon and the chip beacon report each other's codes to the system. In one embodiment, the design of the of the casino chips/tokens are disclosed. The casino chip/token comprises negative and conductive means, repelling magnets on one of the poles, on the layout and in the chips, amplifiers and a current detector. When chips are placed, the current passes through an amplifier and a current detector, and the power that is consumed by the casino chips' beacons would be measured. The total consumed power in each of the table bet bases is calculated and sent to a computer system that identifies how many chips/tokens are placed from the consumed power and where is their position through the code of the table bet base beacon.

In another embodiment, detection of encoded casino chips/tokens using light color detector is disclosed. Every bet comprises a different colored LED or laser light directed upwards and every casino chip/token would contain inside it: a light color detector, a BLE and a USB UART bridge (that could be embedded inside the BLE chip or the light sensor, or independent), as well as a battery; the encoded casino chip/token will report the color that passes through the glass part of the chip/token. The casino chip/token comprises a transparent center region that works as a lens that passes the light. The casino chip's transparent center region is covered with transparent plastic or fiberglass or any other transparent material. The color sensor detects the color passing through the middle lens and reports it in real time to the BLE through the USB UART bridge and then the BLE reports the color to the system. The system is configured to determine the position of one or more chips/tokens on the layout by recognizing the color they report e.g. if a player places a casino chip/token on "0" on a Roulette device, and if the LED/laser light color that relates to "0" (placed on the wagering/betting area of zero) is orange, the chip(s)/token(s) that are placed on "0" will have the orange color passing through their lens and it/they will report the color orange to the computing device. The computing device will know which chips/tokens are played (wagered) on "0" by the number of chips that reported the color orange and could know the total value of all the chips/tokens placed on "0" by matching the code of each of the chips to its monetary values. In one embodiment, the casino chip/token comprises a small double-sided ON/OFF nozzle with a spring that work as a switch. The switch is used to activate the color sensing system components inside the casino chip/token when it is placed flat on the layout and to deactivate the color sensing system components inside the casino chip/token when removed from the layout or when not in use or when it is not placed flat (when it is not flat, there is no pressure on the spring, so the spring is released and the chip/token turns OFF. In one embodiment, the color sensor, the BLE, the USB UART bridge and the battery will all be fitted inside a casino chip/token (Nano technology). The LED or laser lights will be installed on the layout each of them in a betting area i.e. 157 lights on European Roulette, 158 lights on American Roulette and 74 lights on Laysix.

In yet another embodiment, detection of casino chips using light color detector is disclosed. The light color sensor is placed inside the table under the layout top in the table bet bases. The casino chips comprise different color particles inside the transparent center covered with glass. The color sensor of each of the bets (bet bases) is configured to read all the different colors placed on top through light projection from the objects (casino chips/tokens) and reports them to the system. The system determines how many chips/tokens (and which chips/tokens) are placed on top of each of the betting areas through the code of the sensors that are placed under each of the betting areas of the layout and that report the data.

In one embodiment, RFID sensor of the detector device 108 is disclosed. The casino chips each comprise special tags that are printed inside the middle transparent area, these could be either active or passive tags. The tags are very small and they cover the whole transparent area. A directional RFID reader is be placed on each of the bet bases with the signal directed straight upwards. When the device is "ON", the readers are active, and when 1 or more chips is/are placed on top of any of the readers, the readers would read the tags and report the data to the system. The system determines which and/or how many chips are placed on the bet and the position of these chips through a special code for each of the readers.

In another embodiment, the detector device 108 is at least one of a short distance laser or a photoelectric or an ultrasonic sensor. The table bet bases comprises short range photoelectric/laser/ultrasonic sensors that measures distances. The sensors laser beam is directed upwards and it is "ON" when the table is connected to the power supply. Each of the casino chips comprising the transparent center area containing small reflecting particles on the top and bottom of the transparent center. The sensor reports the distances to the system and the system takes the farthest recorded distance and divides it by the thickness of a casino chip (e.g. 3.5 or 4 mm) to determine the number of chips on a bet e.g. if there are 6 chips of 4 mm on "0" on Roulette, the sensor will catch and report many measurements (like 4 mm for the 1st chip, 8 mm for the 2nd . . . 24 mm for the 6th chip, but the system will only take the farthest reported distance which is 24 mm and divides it by the thickness of the casino chip/token which is 4 mm and reports 6 chips/tokens placed on "0".

In yet another embodiment, the detector device 108 comprises 3D cams. In an embodiment, smart digital cams are placed on the table game layout for each of the existing bets and these cams are connected through a PCB to the system (control tablet). The cams are visible to the naked eye and the player need not to cover them when placing chips. When the device is connected, the cams are active. The cams take pictures of the betting areas and reports them to the system. The reported images are compared to a database of 1 to 20 chips images and the system is configured to determine how many chips are placed on the bets. Each of the cams has a special code that identify 1 of the Roulette bets. In yet another embodiment, the cams are configured to capture pictures and update in real-time. In yet another embodiment, the detector device 108 comprises switch that allows the player to press when they are done betting. When clicked, this switch allows the cameras to take the shots and reporting them to the control computer/tablet which would compare the images in real time and place the bets on the layout. The same system can be implemented for other table games like blackjack, poker, Laysix, etc.

The present invention also allows playing card games and allows the players to view the drawn cards by a live dealer or automated, on their own tables at home or in any place outside a physical casino.

In one embodiment, the card game table layout comprises a betting area, functions area and a cards area. The detector device 108 is disposed at the betting area. In one embodiment, the detector device 108 includes, but not limited to digital scales, RFID, BLE, cams etc. when the computing device 106 announces the players to place the bets. The players are required to place the wager casino chips/tokens at the betting area. The detector device 108 detects and identifies the values and positions of the casino chips.

In one embodiment, related to the blackjack table layout/device, the function area comprises one or more components to provide functions such as hit, stand, double, split and surrender. The hit function enables the player to request for an additional card. The stand function enables the player to convey when the user does not need any more cards. The double function represents the player wants to double the bet (play more) before being given 1 card only. The split function represents the player wants to split 2 similar cards and play on each of the cards individually. The surrender function represents the player forfeits the hand and loses half of his/her betting value inside the box.

In one embodiment, display devices are disposed at the cards area. In one embodiment, the display device is a fixed screen for each box that displays the cards that are being opened by an online live dealer or randomly generated by the system. In another embodiment, the display device is a flexible screen to reveal the cards slowly using their hands.

Whether the player is playing on an online live dealer blackjack table or on a random computer card generating table, the system reads the cards from the computing device/tablet screen using a specially developed software that matches the existing cards to a pool of cards in the database and then displays them on external non-bendable/fixed screens and/or on external bendable card display screens (each card could have its own external bendable display screen).

Figure 18:
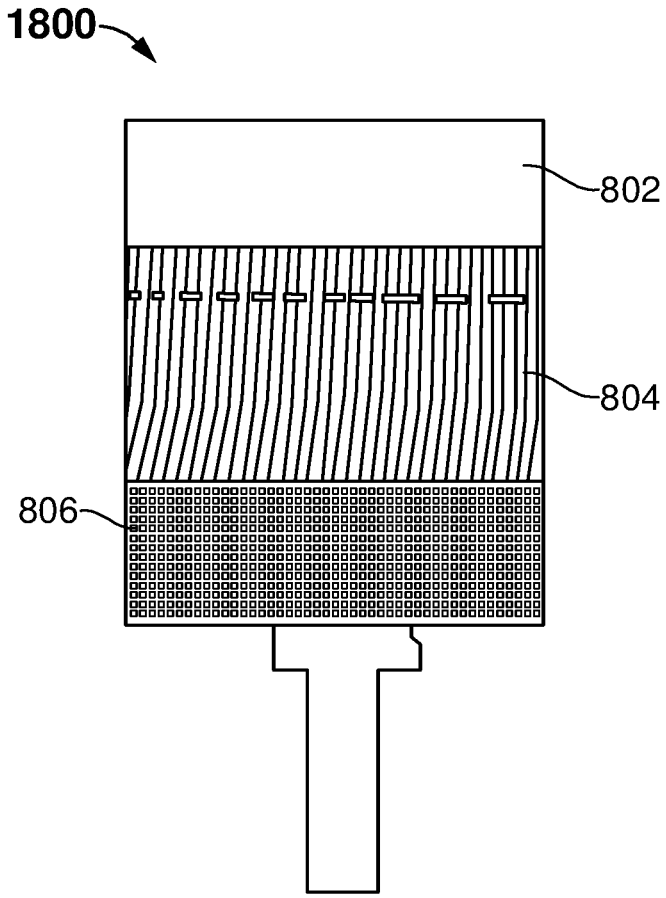
FIG. 18 exemplarily illustrates a flexible screen of a display device, according to an embodiment of the present invention.

FIG. 18 exemplarily illustrates a flexible screen 1800 of a display device, according to an embodiment of the present invention. In one embodiment, the bendable external bendable displays are an ultra-thin bendable and/or rollable screens. The screen is at least one of a LCD, LED, OLED or AMOLED screens with thickness smaller or bigger than the thickness of the normal playing cards. These card screens placed on the player's personal table maybe or may not be covered from one side. The ultra-thin card screens may or may not be fixed on the table layout in Blackjack and Laysix games but they are loose on 1 side in the Poker games so that it enables players to reveal them themselves. In another embodiment, the display device comprises a display screen at an upper part 802, one or more cables connecting the screen at the middle part 804 (which is the bending area i.e. the weak area that allow players to bend the cards to open them and reveal their value) and a bottom part 806 disposed inside the table contains the controls to the screen. The display screen is at least one of a LCD, LED, OLED or AMOLED.

In one embodiment, related to the Texas Hold'em Poker table layout/device, the function area provides one or more functions including but not limited to "Bet", "Call", "Check", "Raise" and "Fold". The Betting represents the player is the first to place a bet in a round, Calling represents a player accepts to put the same amount as another player has put. Checking represents no bets are made and the player likes to keep playing but without betting. Raising represents a player wants to increase the bet over what another player has put. Folding represents a player does not want to continue with the hand i.e. the player withdraws for the hand.

In another embodiment, related to the Caribbean Stud Poker table layout/device or Russian Poker or Pai Gown Poker, the function area provides one or more functions including but not limited to "raise", "fold", "change" (a card), (play the) "bonus" and other functions related to different poker game. "Raise" represents the player would like to play the hand and in this case he/she needs to put casino chips worth double the ANTE in the RAISE box. "Fold" represents the player would like to withdraw from the hand, and in this case the hand is not continued, and the player loses the ANTE bet. "Change" represents the player wants to change 1 or more cards and in this case the player needs to specify the number of cards he/she desires to change. "Bonus" represents the player desires to play 1 or more bonus hands and these vary with the type of poker game the player is playing.

In another embodiment, related to War game table layout/device, the function area provides one or more functions including but not limited to "Play the tie" and "Surrender". If a tie occurred between the dealer and the player, then the player needs to click on "Play the Tie" to continue in the game by doubling the original bet or "Surrender" when a player does not want to continue with the hand i.e. the player withdraws for the hand (in this case the player loses half the bet)

The computing device 106 further comprises voice recognition module that allows the players to give orders and make decisions through voice. When the player clicks on any of the functions and if this function requires betting with chips, then the player needs to put the real chips inside the betting area after clicking on the function that requires betting (e.g. "BET", "CALL", "RAISE"). The system by itself deducts the earlier placed chips from the total chips inside the betting area.

Figure 2:
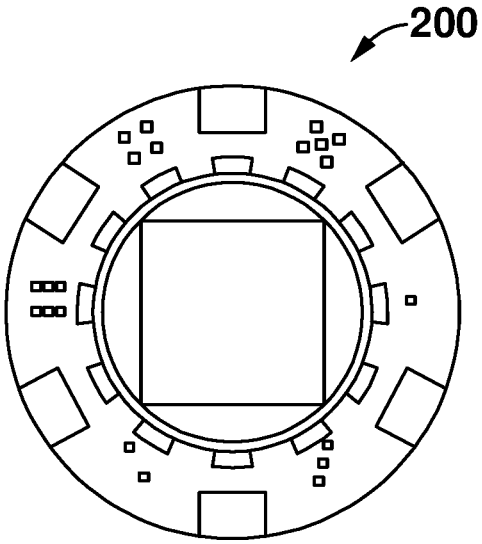
FIG. 2 exemplarily illustrates a casino chip in an embodiment of the present invention.
Figure 3:
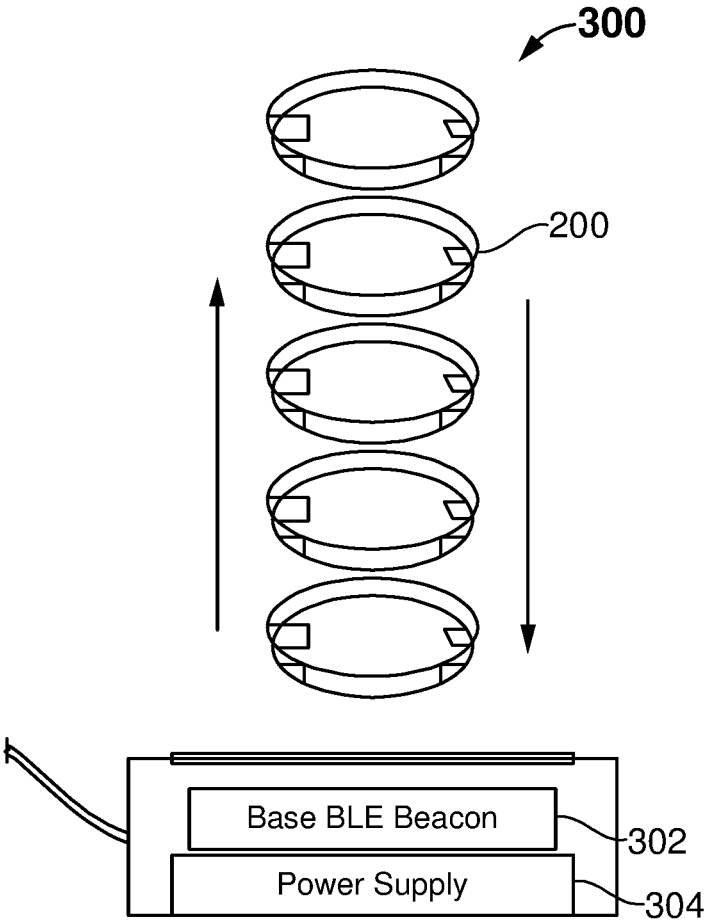
FIG. 3 exemplarily illustrates detection and identification of casino chip in a table layout, according to an embodiment of the present invention.

For an example related to Texas Hold'em Poker game table layout/device: A player calls a bet of 10US$ on the flop (i.e. 10$ are placed in the betting area) if another player raises the bet to 50US$ and the 1st player likes to call, the 1st player would need to put extra 40$ to match the bet of the other player; In this case the 1st player needs to click on "Call" and then need to place only 40US$ in the betting area (the system by itself would identify that 10$ are included in this hand); if the amount placed inside the box is lower than 40$, then the system will not accept the call, if the amount placed inside the box is higher than 40$, then the system will only accept the 40$ that the 1st player is calling (since the 1st player didn't click on the "RAISE" function, he/she is not allowed to raise on the total of 50$). If the 1st player clicked also on "Raise" after the other player raised to 50US$ total, then the system will accept any amount that is placed inside the betting area and that is more than 50 US$; if the amount is = or less than 50 US$ the system will not accept the bets FIG. 2 exemplarily illustrates a casino chip 200 in an embodiment of the present invention. FIG. 3 exemplarily illustrates detection and identification of casino chip 200 in a table layout, according to an embodiment of the present invention. In one embodiment, each of the betting areas includes a BLE beacon that serves as a base module that is activated once the device (table layout) is connected to the power supply 304. The casino chips/tokens 200 also comprise a BLE beacon module and a small CR1616 battery. In one embodiment, the chip/token is designed with a small nozzle that extends to its 2 sides and when the chip/token is placed flat on the digital scale, the nozzle clicks inside and turns ON the BLE beacon module of the chip/token 200. When the chip/token BLE module is ON, it reports all the other beacons' codes in the area. The system will discard all the other chips/tokens BLE module codes and consider only the base module code (The reported codes would be matched in real-time to the database of codes entered in the system and the system identifies which code that is reported belongs to a base and which belongs to another chip/token (i.e. is it another casino chip/token BLE or the table base BLE beacon 302). The system will also take the first reported table base BLE beacon's code as the position of this particular chip since it is the closest in proximity and discards the other codes. Further, the system will identify the position of the chip by using the code of the "Table base BLE beacon". The system will filter all the data and identify the number of chips played in a certain position and converts them to played bets on the online casino roulette layout screen (betting areas).

Figure 4:
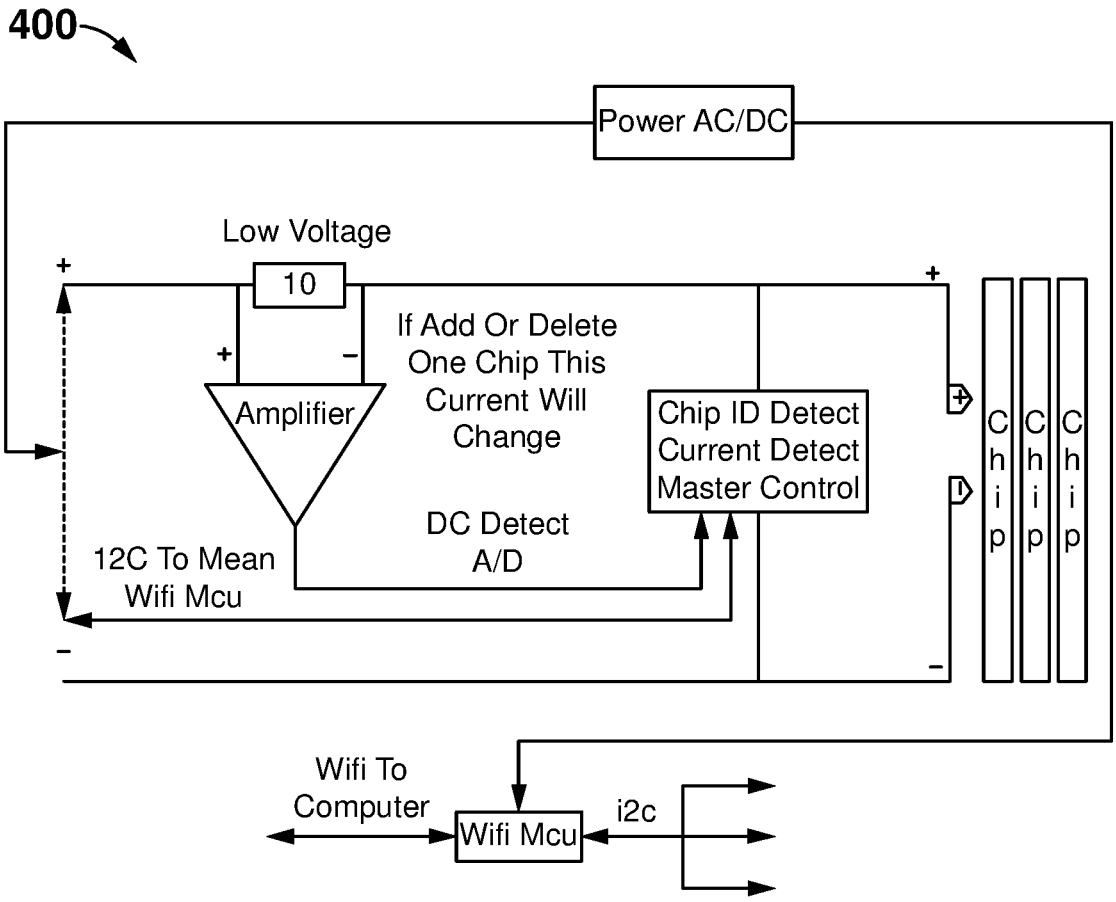
FIG. 4 exemplarily illustrates a circuit diagram of detector device utilizing BLE, according to an embodiment of the present invention.

FIG. 4 exemplarily illustrates a circuit diagram 400 of the detector device utilizing BLE, according to another embodiment of the present invention that doesn't utilize an OFF/ON nozzle and instead the casino chips/tokens contain 2 metal conductive parts one for positive (+) current and another for negative (−) current. In this embodiment, when the device is connected to a power supply, the table electric and electronic components get activated. When a casino chip/token is placed on 1 of the table betting areas (a base that contains a BLE, A current detector that measure the ongoing and the returning current strength and an amplifier), The BLE inside this chip/token gets activated by the power generated from the table base through the conducting metal. When the chip/token BLE is activated, the current detector that measured the passing current from the amplifier, also measures the returning current from the chip/token. Then the BLE will report to the system how much current was consumed in the process. The consumed power is divided by the normal consumption of 1 BLE beacon e.g. if the chip/token BLE beacon consumes 0.1 Watt and the current that sent through the amplifier is 2 watts, then if the returning current power is 1.9 Watts this means that there is 1 chip over this base (betting area), if the returning current power is 1.7 Watts, this means that there are 3 chips on this base (betting area).

Figure 5:
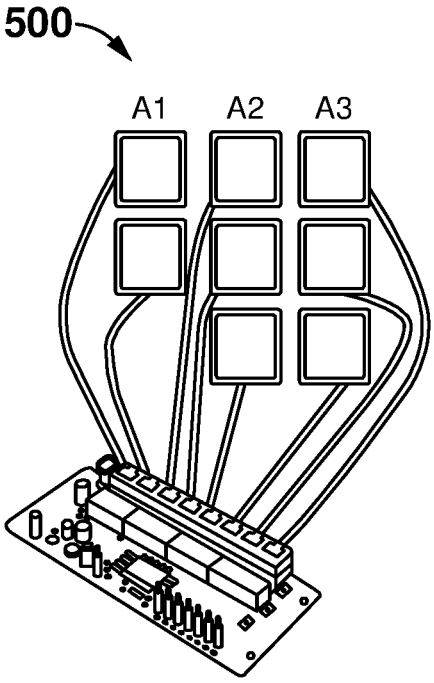
FIG. 5 exemplarily illustrates a digital scale of the detector device connected to a PCB of the computing device, according to an embodiment of the present invention.

FIG. 5 exemplarily illustrates a digital scale of the detector device connected to a PCB of the computing device 500, according to an embodiment of the present invention. The roulette layout area for an example, includes a plurality of digital scales or load cells with tops. In one embodiment, the digital scales would be placed on a strong weighing platform/surface that constitutes a base for the components. In one embodiment, the weighing platform for the digital scales could be made of, but not limited to, metal. In another embodiment, the weighing platform for the digital scales could be made of, but not limited to, plastic, wood or any hard and durable material that enclose/cover the digital scales. In one embodiment, the roulette layout area further includes a plurality of bet scales with larger tops (weighting areas). The bet scales with larger tops would fitted for the outside bets of the roulette table layout.

In one embodiment, the digital scales/load cells are placed under the layout top for each of the possible bets. In one embodiment, the placement of the digital scales could be varied according to the roulette layout area. In an exemplary embodiment, a matrix of electronic scales will include a plurality of digital scales or loadcells. In one embodiment, the digital scales include a shape, but not limited to, a square, round or any other shape. In one embodiment, the digital scales might or might not have an edge of more or less of 1-2 mm to distinguish the different positions of the bets i.e. to be separated by scaling them by 1-2 mm between each and every scale.

In one embodiment, every loadcell/digital scale would have a code that is related to 1 of the bets on the layout table (e.g. The 0 straight-up will have the code S-0, the 0-3 split will have the code S0-3 . . . ). In one embodiment, the digital scales are connected to a printed circuit board (PCB)/mother board that transforms the data from Unicode into the computer readable data. This PCB is connected to a computer system, for example, but not limited to, the tablet, and/or the computing device. In one embodiment, the weight output of each digital scale is transformed into a digital computer data and that could be used in real-time.

In one embodiment, each digital scale could report the total weight to the computer. In one embodiment, a specially designed software could receive the data from the computing device/tablet and identify the number of casino chips/tokens placed on the platform by dividing the total reported weight by the weight of the single chip/token. In an exemplary embodiment, if a single chip/token weighs 8 grams and the player places (plays) for example, but not limited to, 5 chips on "0 straight-up" on the roulette layout area, then the digital scales coded S-0 (e.g. of a code granted to the bet "0 straight-up" in the roulette layout area) will report the total weight of chips that is 40 grams (8 g*5 chips/tokens) to the computer.

Figure 6:
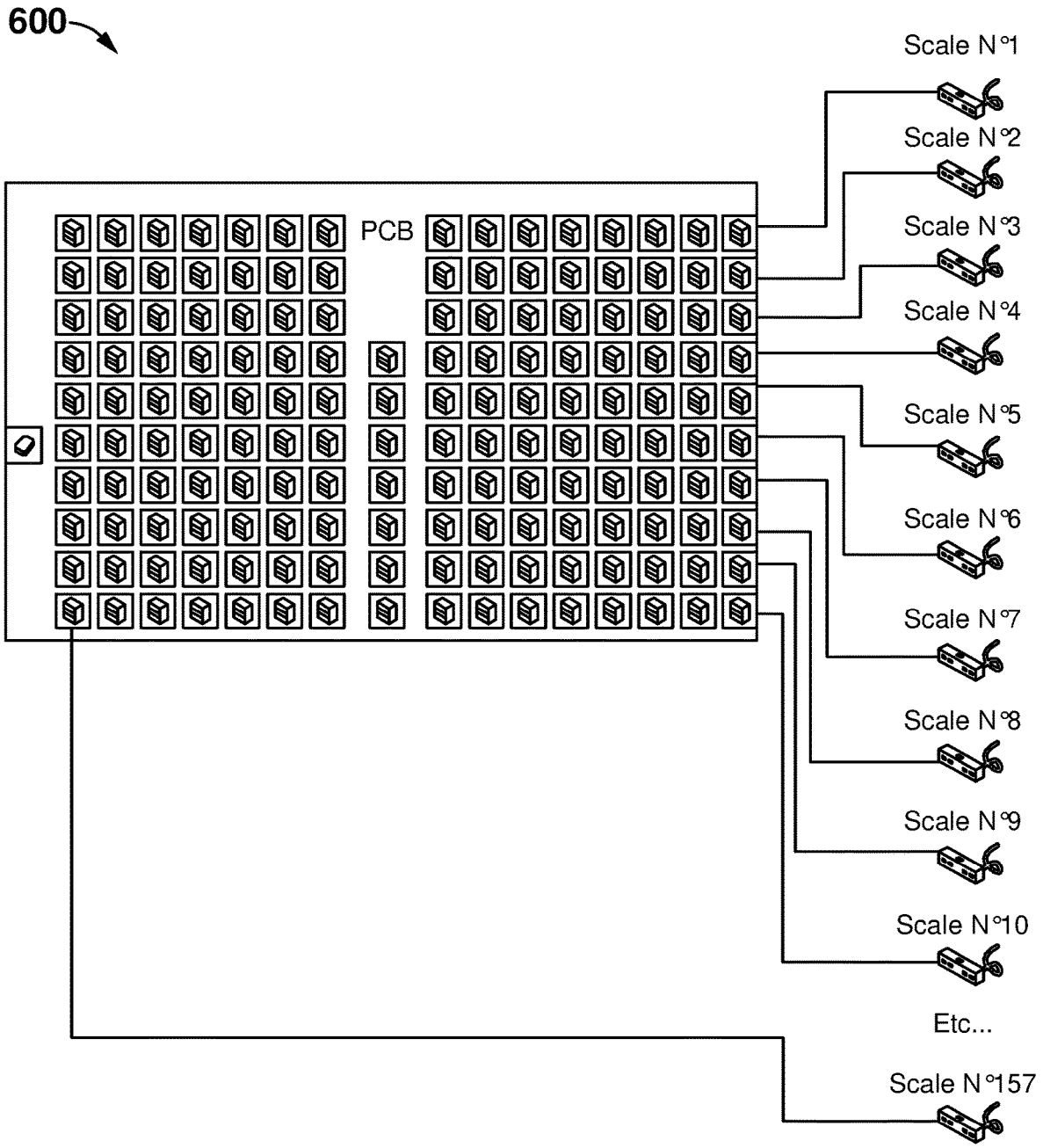
FIG. 6 exemplarily illustrates conversion of weight output of each scale, according to an embodiment of the present invention.
Figure 7:
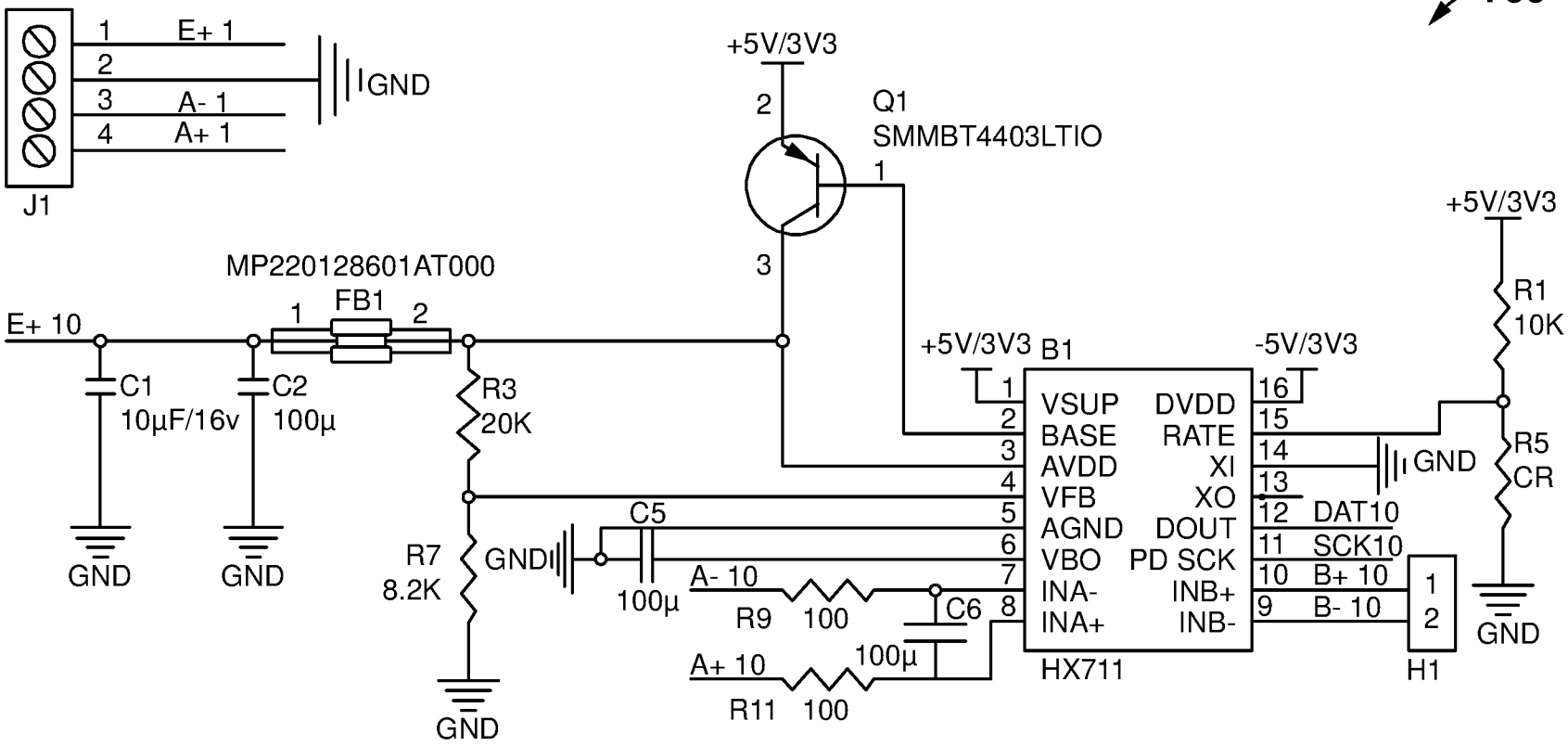
FIG. 7 exemplarily illustrates a circuit diagram of detector device utilizing load cells, according to an embodiment of the present invention.

The software will read the code of the digital scale and divide the reported total weight of 40 grams by the weight of a single chip and also will report the result, which is 5 (i.e. 5 pieces) placed on "0 straight-up" to another special software that places 5 chips on "0 straight-up" on the online casino's roulette layout area on the screen. In an exemplary embodiment, the roulette layout area is divided into multiple scale rows classification. For example, the European (or classic) roulette layout area comprises, but not limited to, 157 scales/loadcells for 157 different bets and the American Roulette layout area comprises, but not limited to, 158 scales/loadcells for 158 different bets. The scales may vary in dimensions to best suit the roulette layout area. In one embodiment, the roulette layout area looks like a normal table with multiple digital scales. In one embodiment, the platform could be covered with a fabric. In an exemplary embodiment, the digital scales are adhesively located under the fabric. FIG. 6 exemplarily illustrates conversion 600 of weight output of each scale, according to an embodiment of the present invention. FIG. 7 exemplarily illustrates a circuit diagram 700 of how data is converted from Unicode to computer language when utilizing load cells, according to an embodiment of the present invention.

Figure 8:
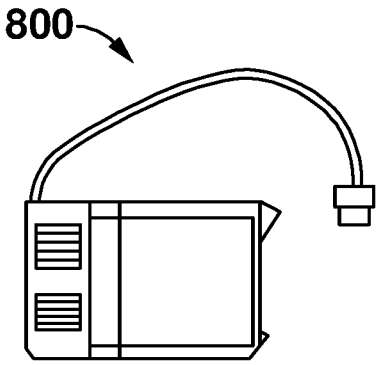
FIG. 8 exemplarily illustrates a battery of a detector device, according to an embodiment of the present invention.
Figure 9:
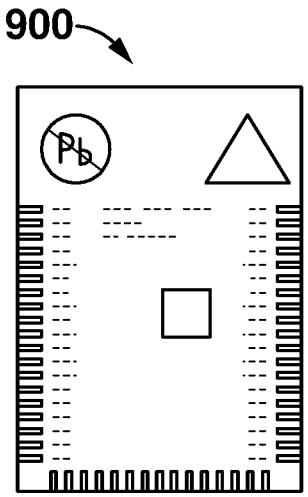
FIG. 9 exemplarily illustrates a BLE of the detector device, according to an embodiment of the present invention.
Figure 10:
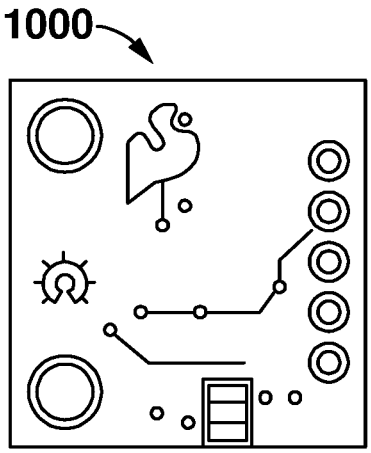
FIG. 10 exemplarily illustrates a color sensor of the detector device, according to an embodiment of the present invention.
Figure 10A:
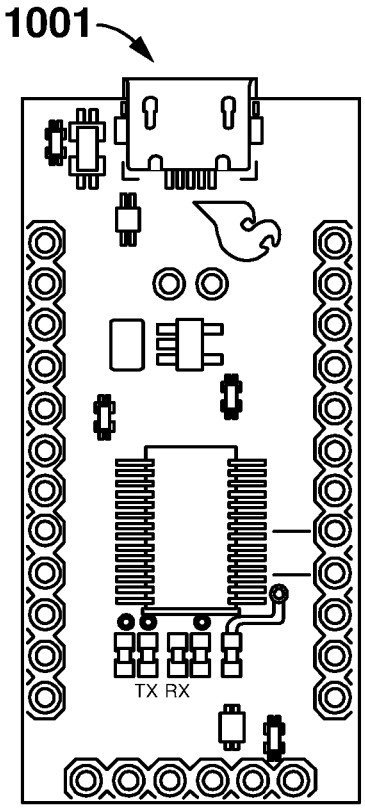
FIG. 10A exemplarily illustrates a UART bridge that is either separate, or embedded in the BLE or the color sensor.

FIG. 8 exemplarily illustrates a battery 800 of a detector device, according to an embodiment of the present invention. FIG. 9 exemplarily illustrates a BLE 900 of the detector device, according to an embodiment of the present invention. FIG. 10 exemplarily illustrates a color sensor 1000 of the detector device, according to an embodiment of the present invention. FIG. 10A exemplarily illustrates a USB, or any other protocol, UART Bridge to transfer data wirelessly from the BLE to the computing device/tablet.

Figure 11:
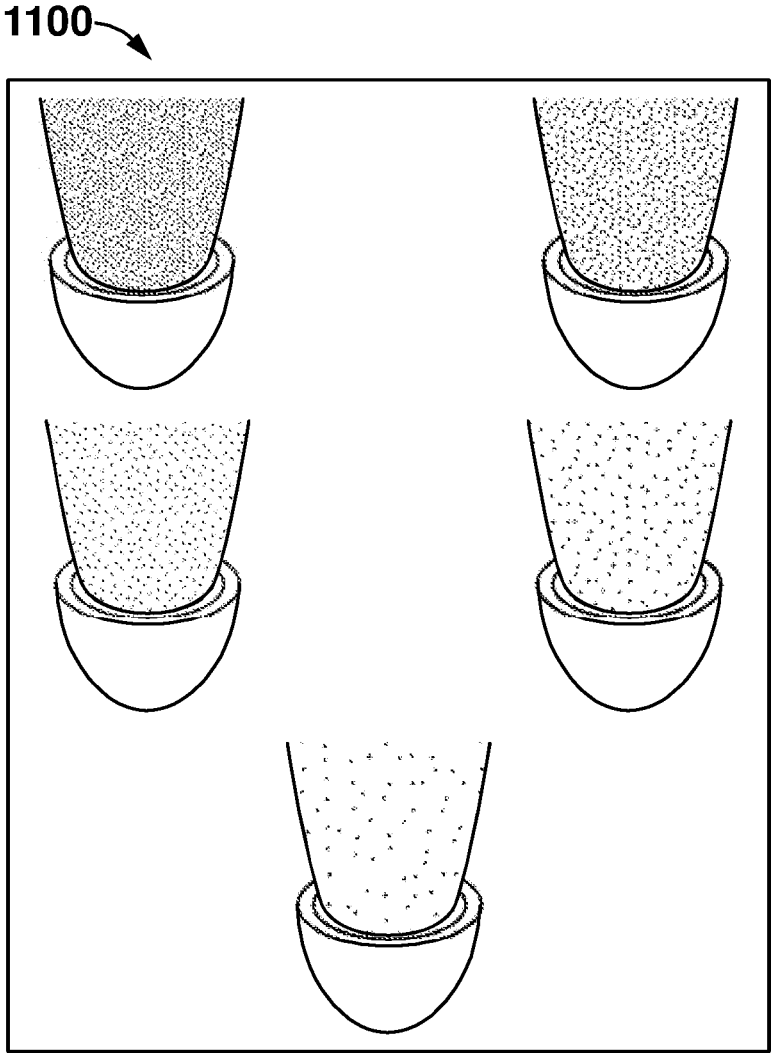
FIG. 11 exemplarily illustrates a lighting device of the detector device, according to an embodiment of the present invention.

FIG. 11 exemplarily illustrates a lighting device 1100 of the chip/token detecting system, according to an embodiment of the present invention. In one embodiment, the lighting device 1100 could be at least one of a LED or laser light.

Figure 12:
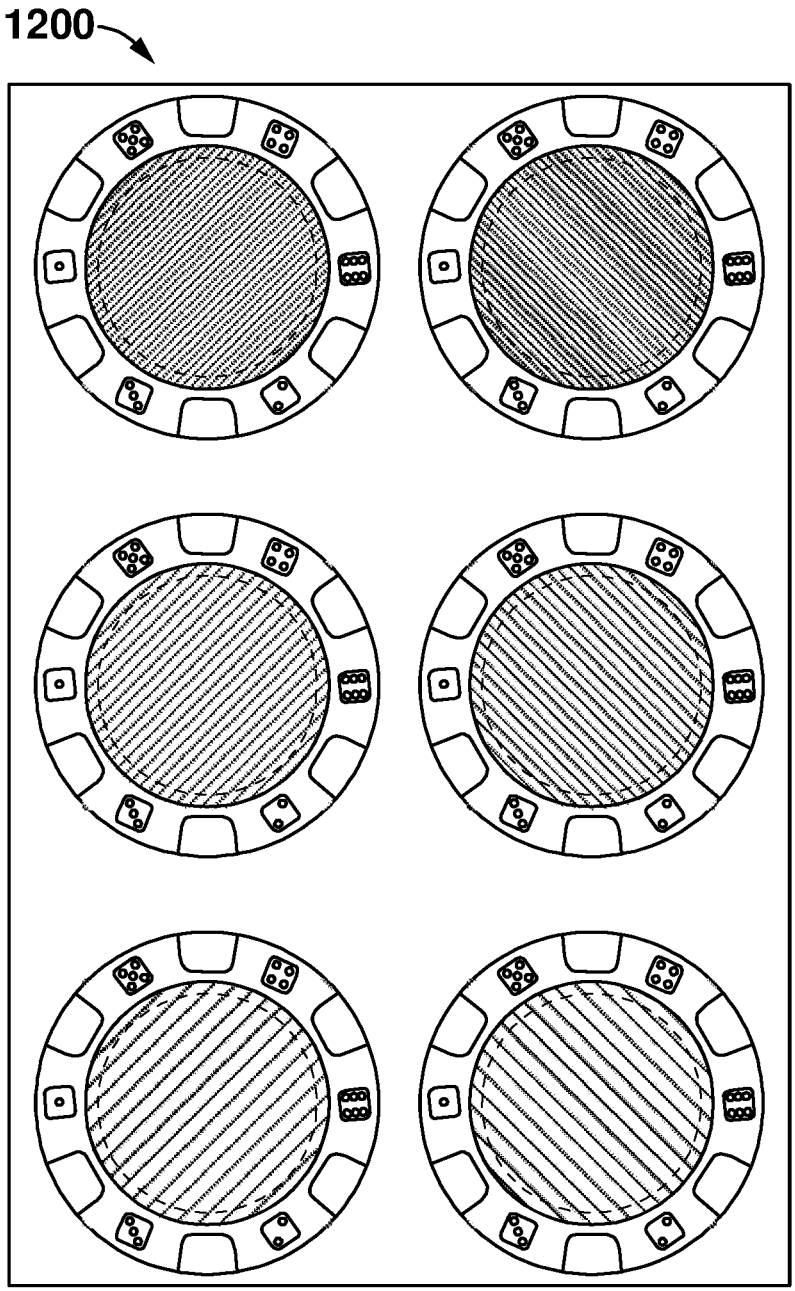
FIG. 12 exemplarily illustrates a plurality of casino chip comprising different colors, according to an embodiment of the present invention.
Figure 13:
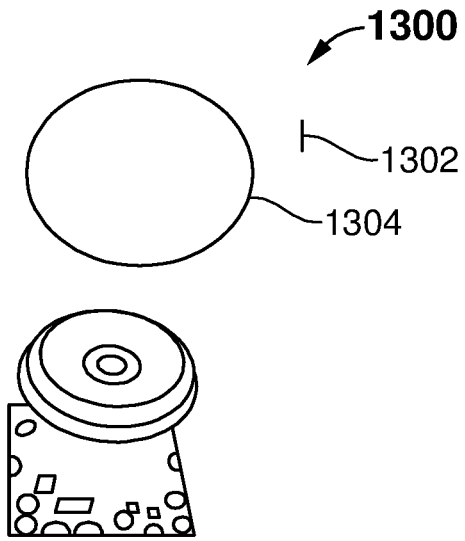
FIG. 13 exemplarily illustrates an exploded view of the camera disposed on the game layout, according to an embodiment of the present invention.

FIG. 12 exemplarily illustrates a plurality of casino chips/tokens comprising different colors 1200, according to an embodiment of the present invention. The casino chip comprises a transparent center portion. Each casino chip comprises a unique color. The different colored casino chips are represented by utilizing different pattern of shades to provide clear picture. FIG. 13 exemplarily illustrates an exploded view of the camera 1300 disposed on each of the game layout betting areas, according to an embodiment of the present invention. The cameras 1300 are all connected to a power supply. The cameras 1300 are configured to capture screenshots of the casino chips of different color placed on top of them. The camera 1300 comprises a transparent glass 1302, an ON/OFF tiny nozzles 1304 that activates the camera when a chip is placed on top of it.

Figure 14:
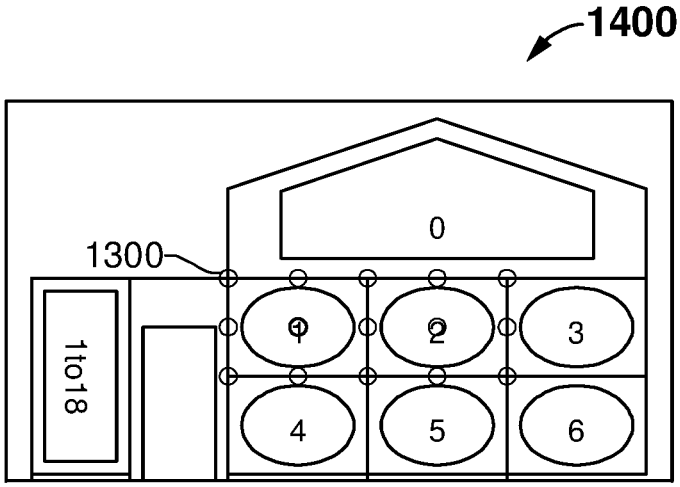
FIG. 14 exemplarily illustrates a placement of cameras on the game layout, according to an embodiment of the present invention.

FIG. 14 exemplarily illustrates a placement of cameras 1300 on the game layout 1400, according to an embodiment of the present invention. The camera 1300 is configured to activate on placement of one or more casino chips on any of the bets. The camera 1300 would start capturing images of the chips on top and reporting them to the computing device. The computing device would match the colors of the casino chip to a screenshot of colors and reports the colors to the system software. The computing device is configured to identify the position and value of the chips placed on a certain camera from the code of the camera 1300 that reported the images. If the chips are placed in a way that doesn't make possible to the camera 1300 to capture any color, i.e. the reported images are dark, then the system would determine that chips are wrongfully placed over the particular camera 1300, then the system prompts the player to fix the chips on this particular betting area.

Figure 15:
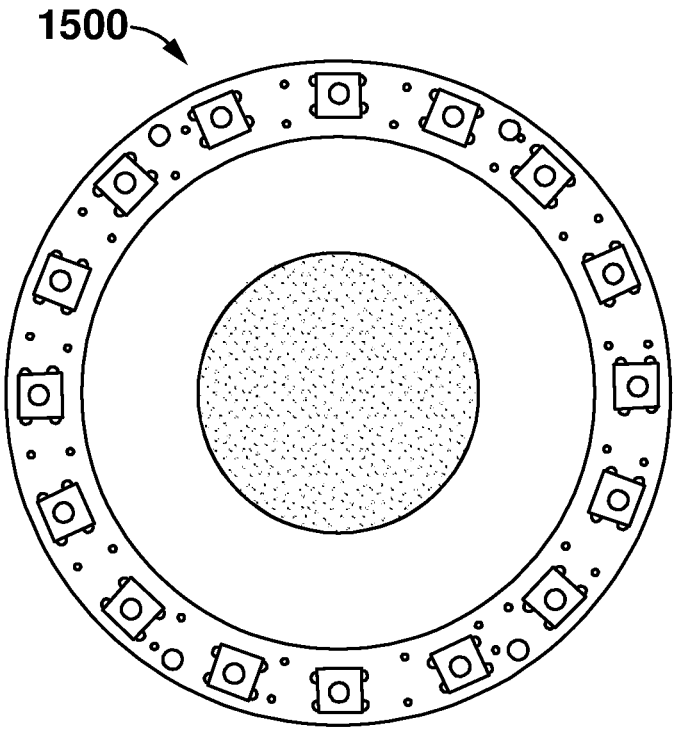
FIG. 15 exemplarily illustrates a casino chip comprising a plurality of particles, according to an embodiment of the present invention.
Figure 16:
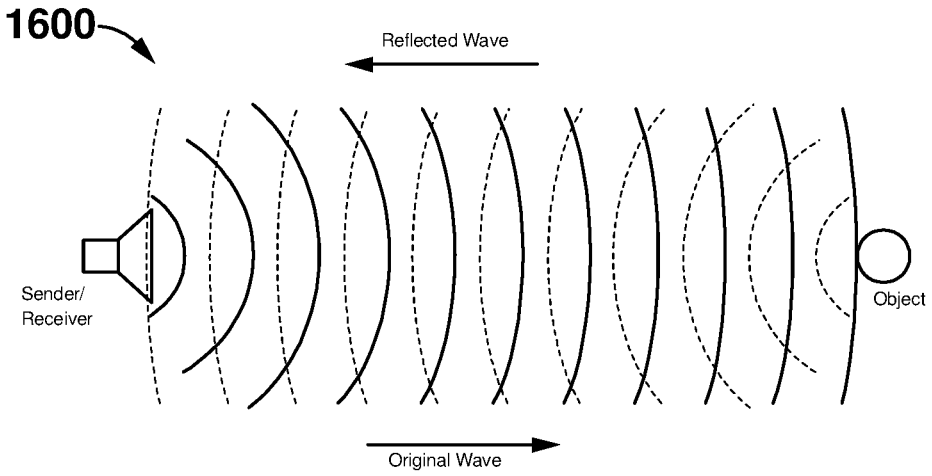
FIG. 16 exemplarily illustrates working of an ultrasonic distance sensor placed on the game layout, according to an embodiment of the present invention.
Figure 17:
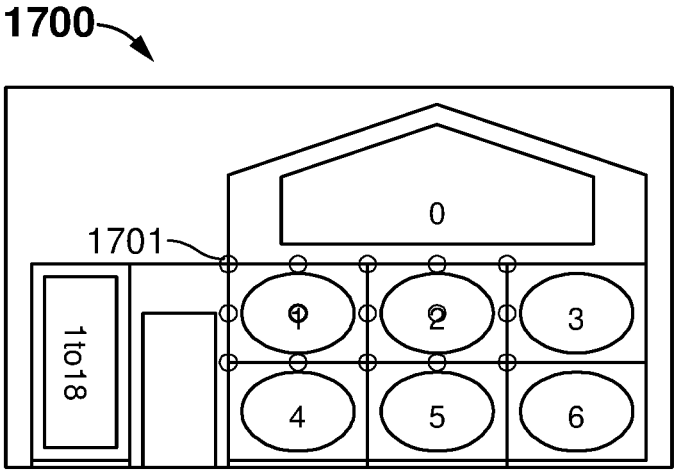
FIG. 17 exemplarily illustrates the ultrasonic distance sensor placed on the game layout, according to an embodiment of the present invention.

FIG. 15 exemplarily illustrates a casino chip 1500 comprising a plurality of particles, according to an embodiment of the present invention. In one embodiment, the plurality of particles is disposed at the transparent center of the casino chip. In one embodiment, the detector device is an ultrasonic, a photoelectric or a laser distance sensor. FIG. 16 exemplarily illustrates working 1600 of an ultrasonic, a photoelectric or a laser distance sensor placed on the game layout, according to an embodiment of the present invention. The distance sensor sends waves or laser light and get blocked by the particles in the casino chips/tokens, as the particles are dispersed, there are vacant areas in between the particles in every chip/token. The farthest (top) chip will transmit the wave or the light back to the receiver through the other chips'/tokens' areas that are vacant/empty from particles. The sensor receives a plurality of distance data from the different chips on top but the computing device would only consider the farthest wave/distance reported and discard all the other data. The farthest wave is the wave that is retracted from the farthest/top casino chip in a stack. The computing device is configured to divide the distance received from the farthest chip on top of the sensor by the thickness of one casino chip. For example, if the reported distance is 20 mm (the farthest chip/token on top is 20 mm) and the casino chip thickness is 4 mm, meaning there are 5 chips on top of the sensor and if the farthest distance reported is 4 mm, this means that there is only one casino chip/token on top. FIG. 17 exemplarily illustrates the ultrasonic, photoelectric or laser distance sensor 1701 placed on the game layout 1700, according to an embodiment of the present invention.

Figure 19:
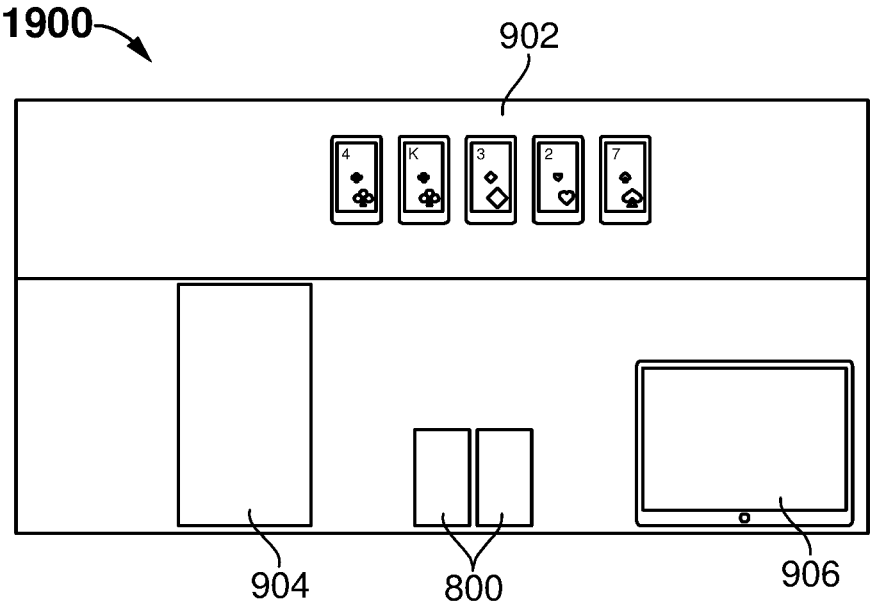
FIG. 19 exemplarily illustrates a layout/1-player-area of Texas hold 'em poker implemented by the system, according to an embodiment of the present invention.

FIG. 19 exemplarily illustrates a layout (a one player area) 1900 of Texas hold 'em poker implemented by the system, according to an embodiment of the present invention. The layout 1900 comprises a cards area 902 comprising flexible screens 800, betting area 904 and the tablet 906. The detector device is disposed at the betting area. In one embodiment, the detector device includes, but not limited to digital scales, RFID, BLE, Sensor. when the computing device announces the players to place the bets. The player(s) is (are) required to place the casino chips in the betting area. The detector device 108 detects and identifies the values and positions of the casino chips. In one embodiment, a method of playing Texas hold'em utilizing the layout 1900 of the system of the present invention is disclosed. At one step, the layout is plugged and it displays the credit on the special screen. In case the player wanted to buy credit, he/she should choose "buy credit" from the screen list. At another step, the players have to click on "play Texas hold'em" option on the screen. At another step, the player could choose the table they want to sit on. In one embodiment, betting and all other functions could be automated whereby decisions are made on electronically except that players have the option of seeing their cards in front of them through the new technology. In another embodiment, betting activities, decisions, functions and seeing the cards can partly or all be done manually by the player(s) in external functions added to the table layout/device At another step, the system shuffles the cards randomly (when there is no online live dealer) or through a live online dealer and the players have to place small blind and big blind by turn. At another step, the players place their bets using the screen buttons, make decisions, and participate in the game based on the normal online game (with a timer). At another step, the cards appear on the card screens in front of the players face down and they are revealed on their operation screen.

If the player wanted to reveal the cards him/herself, he/she should not look at the computing device/tablet screen, only at his/her card screens or he/she could click on a function called "Hide screen cards" whereby the player's cards on the screen will be hidden. At another step, the player's cards also appear on the player's layout screen as soon as they are drawn . . . . In one embodiment, there is a hold button for each player for credit purchasing that could be used only once every hour. When the button is clicked, the system will hold the game for 20 seconds. If the player wants to buy credit, he has to do so in 1 minute otherwise any other player could take his/her seat in the game.

Figure 20:
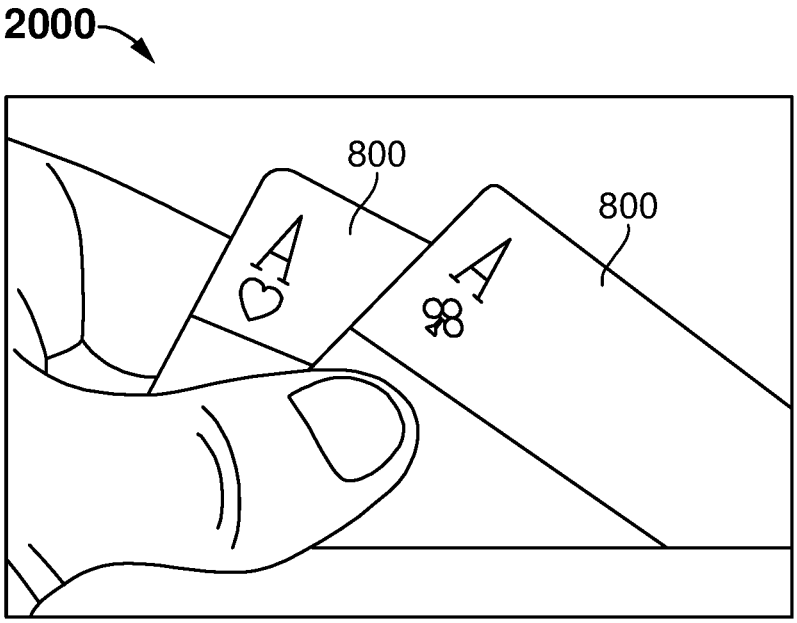
FIG. 20 exemplarily illustrates a user playing with the flexible screen in replacement of real cards, according to an embodiment of the present invention.

FIG. 20 exemplarily illustrates a user playing 2000 with the flexible screen 800 in replacement of real cards, according to an embodiment of the present invention.

Figure 21:
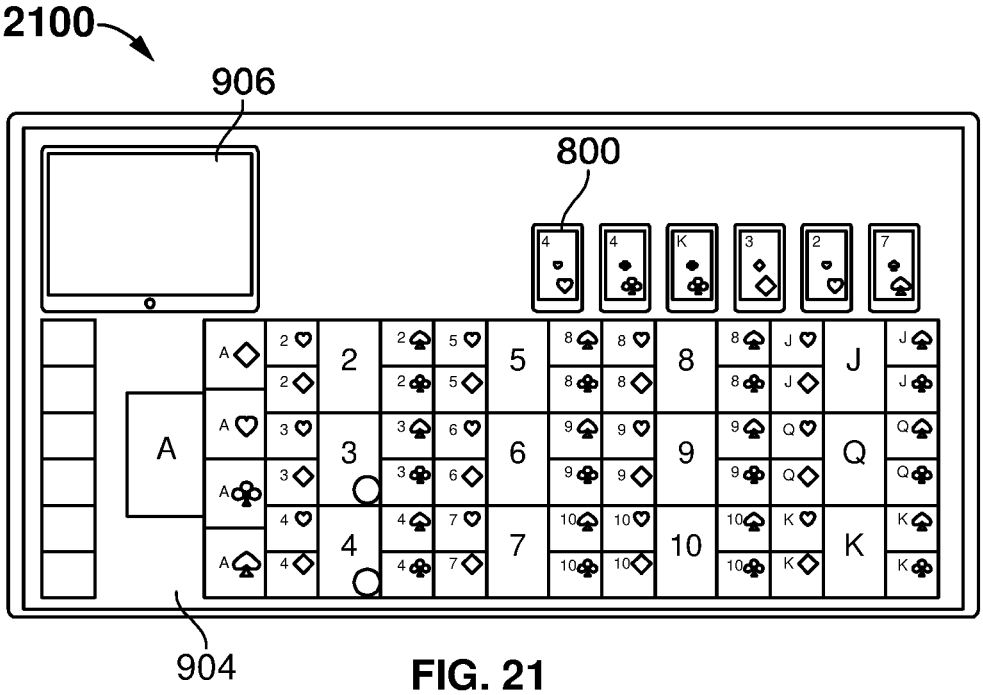
FIG. 21 exemplarily illustrates a layout of Laysix game implemented by the system, according to an embodiment of the present invention.

FIG. 21 exemplarily illustrates a layout 2100 of Laysix game implemented by the system, according to an embodiment of the present invention. The layout 2100 comprises a cards area 902 comprising either flexible or non-flexible fixed screens 1800, or the cards would be shown on the computing device/tablet, a betting area 904 and computing device/tablet 906. In one embodiment, a method of playing laysix utilizing the system of the present invention is disclosed. At one step, the layout is plugged. In case the player wanted to buy credit, he/she should choose buy credit from the screen list. At another step, the players have to click on "play laysix" option on the screen. At another step, the players choose the denomination/value of one chip/token for the next round. At another step, the system announces the "place your bets". At another step, the players could start placing bets on the layout and the system alerts the player that he/she has 5 seconds to click the "make your consent" button before announcing the "No More Bets" and the player has 5 seconds to make any changes. At another step, the system announces "no more bets" and it stops accepting any bet changes further, the system announces the total of the bets made for the player.

Figure 22:
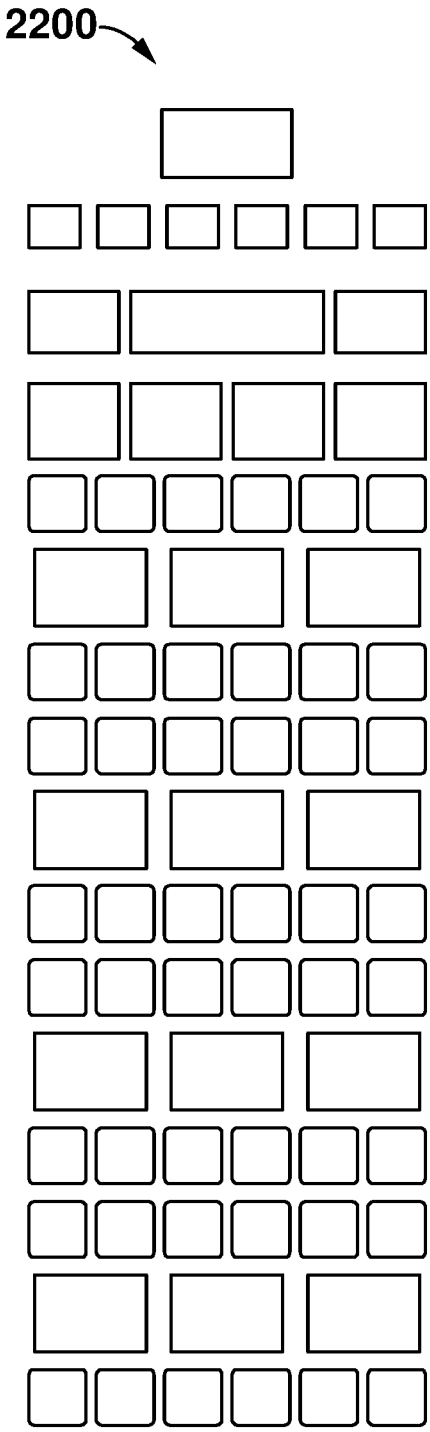
FIG. 22 exemplarily illustrates a layout of the laysix game implemented by the system that uses load cells to detect the position and number of chips that are placed (played) on each of the bets, according to an embodiment of the present invention.

At another step, the system draws 6 cards and announces every card and winnings for the player. The cards appear on the card screens on the player's layout. Further, at step, the system announces the "card shuffling". If there are no shuffle machines with live dealers then the system announces that "place your bets please" directly. In case automated shufflers existed with live online dealer, the dealer announces "place your bets for the next hand". FIG. 22 exemplarily illustrates a load cell layout 2200 of the Laysix game implemented by the system, according to an embodiment of the present invention.

Figure 23:
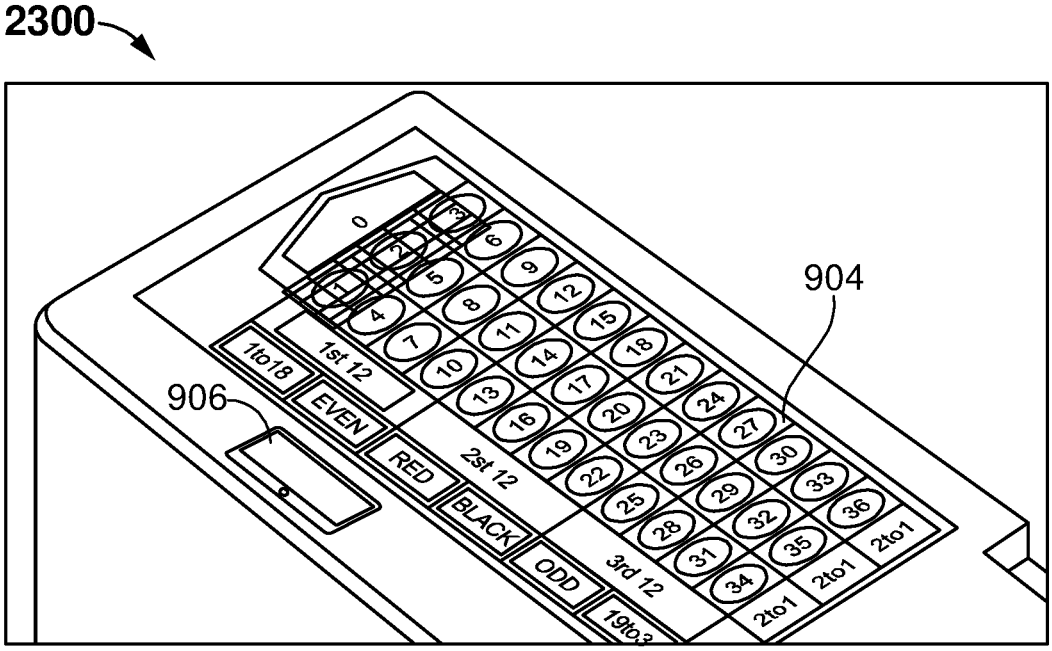
FIG. 23 exemplarily illustrates a layout of Roulette game implemented by the system, according to an embodiment of the present invention.

FIG. 23 exemplarily illustrates a layout 2300 of Roulette game implemented by the system, according to an embodiment of the present invention. The layout 2300 comprises a betting area 904 and a computing device which is a tablet 906. In one embodiment, the system enables players to play/place bets using load cells.

In one embodiment, a method for playing roulette game includes multiple steps. In this embodiment the system is configured to detect 3rd party roulette game software. If the roulette game software is 3rd party i.e. the Roulette game software is not developed by the same entity that provides the Roulette device subject of this invention and cannot be accessed or modified, then the multiple steps are as follows:

At one step, the Roulette game table layout/device is connected to the power supply. At another step, the computing device/tablet is connected to the internet. At another step, the player uses the computing device/tablet to browse the desired online casino and then install the casino app if it's the first time or if needed, then he/she needs to create an account if needed, then he/she needs to log in to his/her account if needed, then he/she needs to install the online casino Roulette game's app that can be played on the device if it's the first time or if it's needed. At another step, the player could login into his/her user's account on the computing device/tablet and after the successful login, he/she has to click on the Roulette game app to be able to play on the Roulette game device he/she has connected. At another step, the player needs to click on "Mark Roulette Layout Position" function and he/she needs to touch, or draw a frame around the Roulette layout on the computing device/tablet screen (to specify the position of the Roulette layout perimeter). At another step the player touches, or draws a frame around, the Roulette Layout. If the player doesn't touch, or draw a frame, around the Roulette layout in 10 seconds, then the device will not be activated, and the player can continue playing on the computing device/tablet. If the player touches, or draws a frame around, the Roulette layout, then the program highlights the perimeter of the Roulette Layout and request the player to confirm that the roulette layout is inside the perimeter. If the player clicks on "confirm No", the system asks the player to repeat the process of touching or drawing a frame around the Roulette Layout. If the player selects "confirm Yes", then the system will start accepting bets from the Roulette device subject of this invention.

Further step, the player could choose the denomination/value of the chip before starting to play the roulette game and start placing bets on the physical/real layout area. The system could recognize the bets placed and playing them itself on the screen.

In the above embodiment, to enable the system to know where to place the casino chips/tokens when the Roulette game software is developed by a 3$^{rd}$ party and cannot be accessed or modified by the party that is providing the Roulette table layout/device subject of this invention, a software was developed that works on behalf of the mouse or touch screen and that transforms the results (data) received from the positioning technologies (scales, BLE, RFID, Cameras . . . ) into played bets on any of the online roulette game table layouts of any 3rd party online casino Roulette game. This software enables the system to identify the layout of the Roulette table through object recognition, and then identifies the places of the roulette bets on the computing device/tablet screen. The object recognition software does the following tasks: After the player highlights the position of the Roulette layout on the screen, the invention app will take a screenshot of the highlighted layout and photo match the position of the available Roulette layout with a database of already existing roulette layouts to know where every bet is on this particular 3$^{rd}$ party online casino Roulette layout (the angle and dimensions of the layout will be taken into consideration), then the system will keep in the invention app database the same position of this particular Roulette layout and its individual bets positions to automatically identify these positions when the player logs in to his/her account in the same casino and connects the device.

Whenever a bet is placed on the real layout subject of this invention, the software will recognize how many chips are played in a particular position (through any of the technologies like Scales, BLE, Cameras . . . ) and will inform the recognition software/system where to put the chips on the third-party online casino's Roulette layout displayed on the computing device/tablet. When the system identifies the position of every bet on the Roulette table of this particular online casino, the system will know where to place the requested betting option. In another embodiment After the player specify the perimeter of the 3$^{rd}$ party online casino Roulette layout by drawing a frame around it, the system dissects the screen (layout) into many parts, and takes screenshots of each of these parts separately. The system then identifies betting areas by matching the pixels of these betting areas to a database that is entered to the system E.g. of a betting area: The system takes the section image of the number 0 on Roulette and matches it to all the images of the different roulette betting areas in the database, the photo shot of the bet "0" will match the same image of the bet "0" in the database and it will know that the bet 0 is in this position. After this, if the player places 3 casino chips/tokens on "0" the system will place 3 chips on the 3$^{rd}$ party online casino table layout that is displayed on the computing device/tablet. If the roulette game software is developed inhouse (i.e. by the same provider of the Roulette table layout device subject of this invention), then the system would be configured to identify the place of each of the bets placed on the roulette layout device directly while playing.

In one embodiment, the system could identify the value and position of the chips using tiny load cells scales position in the places of each of the Roulette bets under the device layout top area. These scales could report weight to a linked software that analyzes the number of chips played on a specific area. Every potential betting area will have its own scale connected to its unique code in the software that identifies the value (or number of played chips) by dividing the weight of the chips by the weight of a single chip. In one embodiment, the program could calculate the number of chips and value of the single chip played in the specific area, and also calculates the total value of all the chips played in the specific area.

Figure 24:
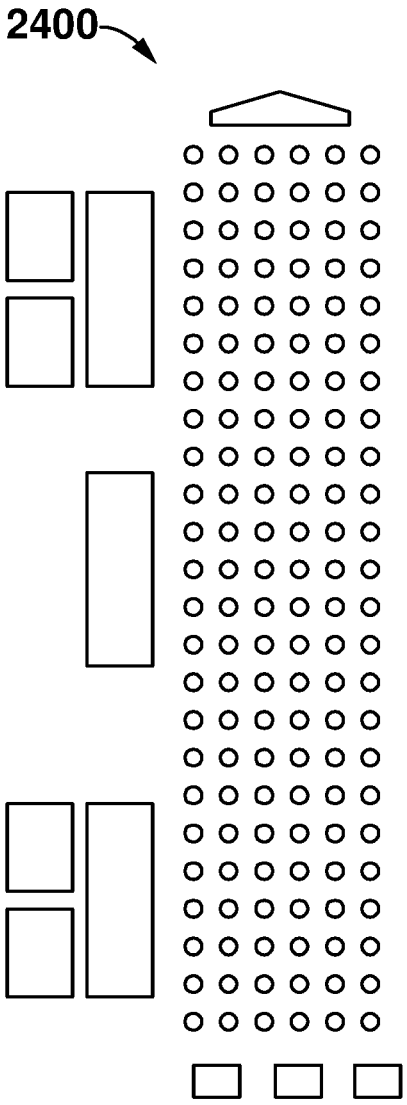
FIG. 24 exemplarily illustrates a load cell layout of the Roulette game implemented by the system, according to an embodiment of the present invention.
Figure 25:
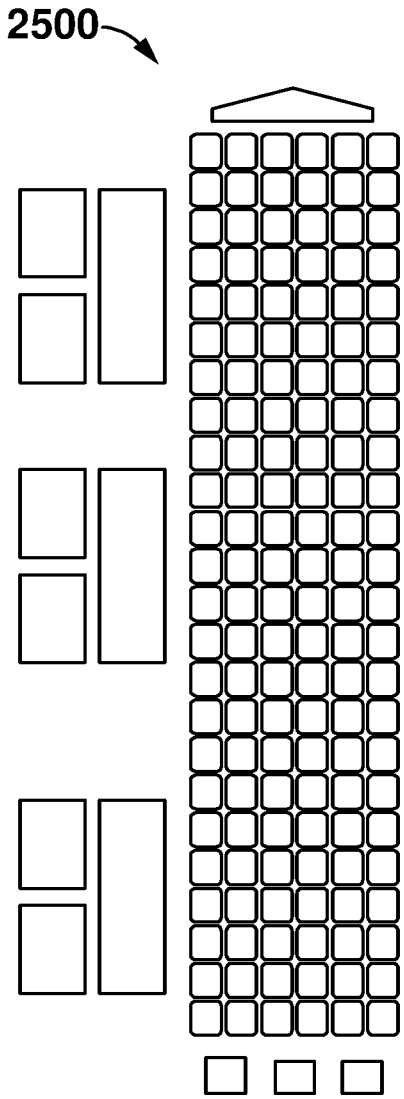
FIG. 25 exemplarily illustrates a BLE layout of the Roulette game implemented by the system, according to another embodiment of the present invention.

FIG. 24 exemplarily illustrates a BLE layout 2400 of the Roulette game implemented by the system, according to an embodiment of the present invention. FIG. 25 exemplarily illustrates a load cell layout 2500 of the Roulette game implemented by the system, according to another embodiment of the present invention.

Figure 26:
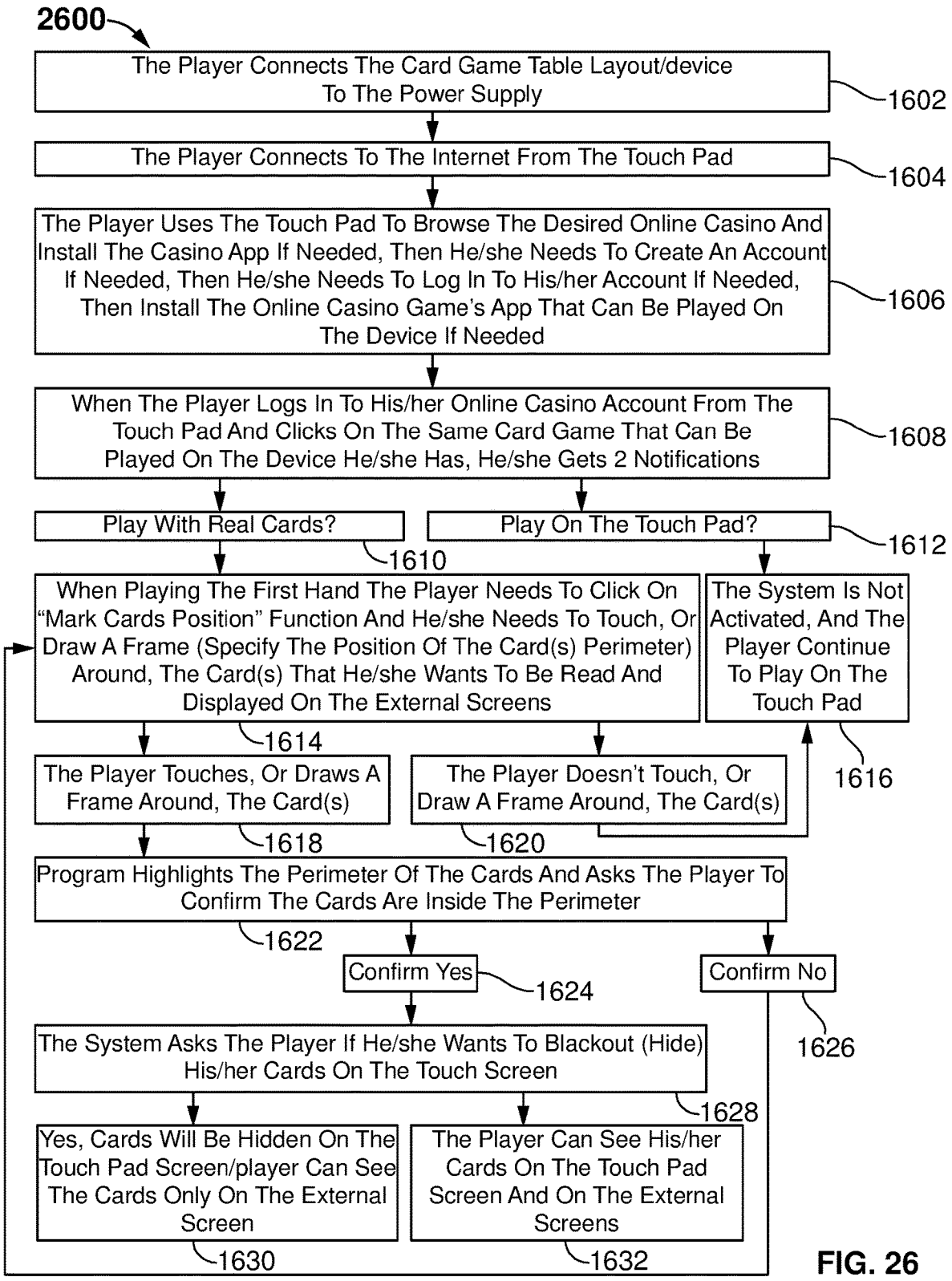
FIG. 26 exemplarily illustrates a flowchart for playing casino card games with live wager-based gaming environment of the system, according to an embodiment of the present invention.

FIG. 26 exemplarily illustrates a flowchart 2600 for playing casino card games with a live wager-based gaming environment of the system, according to an embodiment of the present invention. At step 1602, the card game table layout/device is connected to the power supply. At step 1604, the touch pad is connected to the internet from the touch pad. At step 1606, the player uses the touch pad to browse the desired online casino and then install the casino app if it's the first time or if needed, then he/she needs to create an account if needed, then he/she needs to log in to his/her account if needed, then he/she needs to install the online casino game's app that can be played on the device if it's the first time or if it's needed. e.g. if the player has the Texas Hold'em Poker device subject of this invention, then he/she should either install the Texas Hold'em Poker app from the desired casino, or play directly on the Texas Hold'em Poker's web app game whichever is available from the online casino.

At step 1608, the player could login into his/her user's account on the touch pad and after the successful login, he/she has to click on the same card game that can be played on the same device he/she has connected, and the system requests the player to select at least one option. At step 1610, the player could select "play with real cards". At step 1612, the player could also select "play on the touch pad". If the player selects "play on the touch pad", then the player continues to play on the touch pad and the system is not activated at step 1616. If the player selects "play with real cards", and if it was the player's first ever hand, the player needs to click on "Mark Cards Position" function and he/she needs to touch, or draw a frame around the card(s) (specify the position of the card(s) perimeter) that he/she wants to be read and displayed on the external screens at step 1614.

At step 1618, the player touches, or draws a frame around, the card(s). If the player doesn't touch, or draw a frame around, the card(s) in 10 seconds at step 1620, then the system sends the player to step 1616 i.e. the device will not be activated and the player will continue playing on the touch pad. If the player touches, or draws a frame around, the card(s), then the program highlights the perimeter of the card(s) and request the player to confirm the card(s) is(are) inside the perimeter at step 1622. At step 1624, the system again requests the player to click on "confirm Yes". At step 1626, the system also requests the player to click on "confirm No". If the player clicks on "confirm No", the system sends the player to step 1614 to repeat the process. If the player selects "confirm Yes", then the system could request the player if he/she wants to blackout (hide) his/her cards on the touch pad at step 1628. If the player selects Yes, then the cards will be hidden on the touch pad screen and the player could see the cards only on the external screen at step 1630. If the player selects No, then the player could see his/her cards on the touch pad screen and on the external screens at step 1632.

Figure 27:
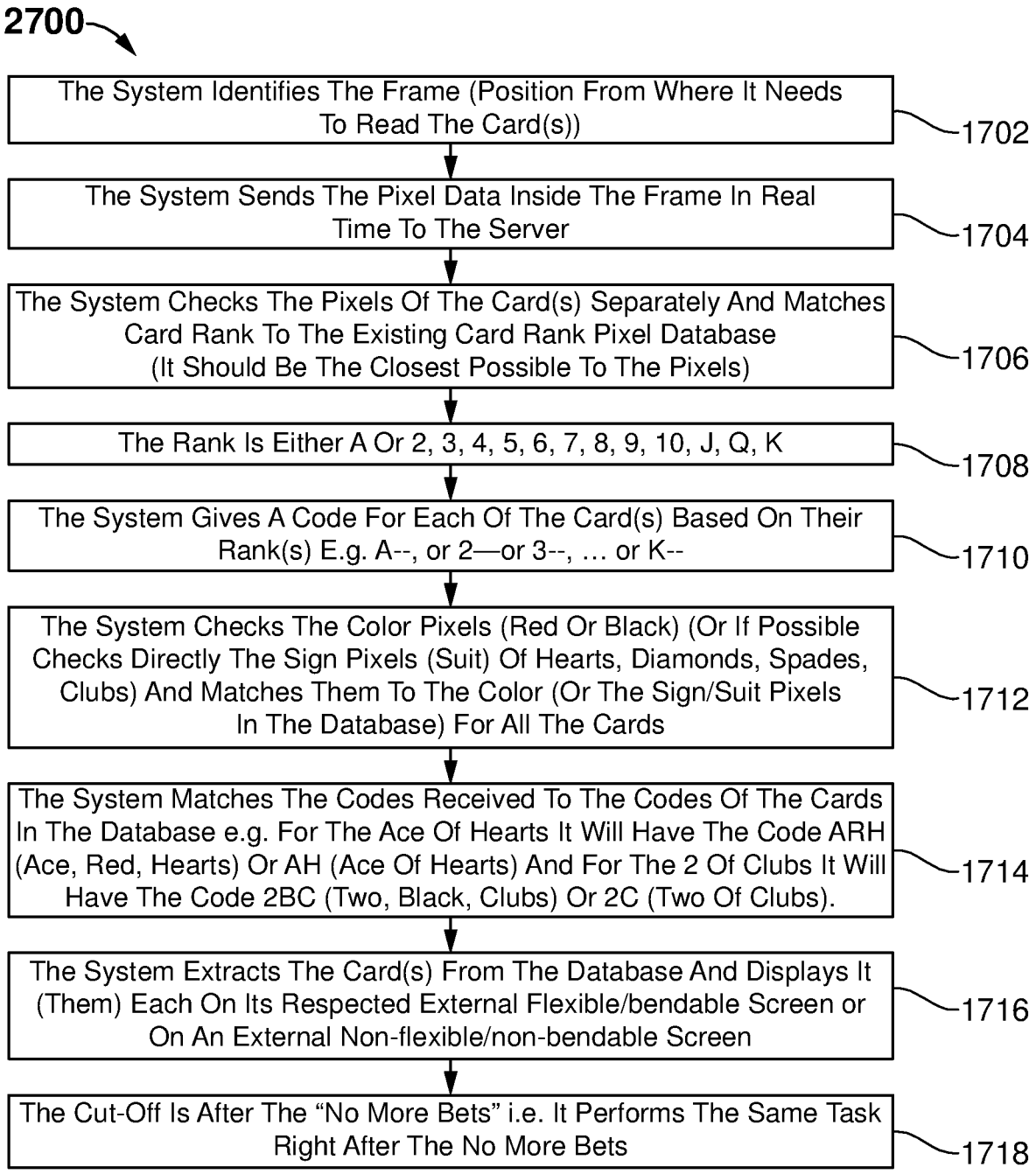
FIG. 27 exemplarily illustrates a flowchart for how the system detects and identifies the card(s) and displays the cards on an external flexible/bendable or non-flexible/non-bendable screen in the live wager-based gaming environment of the system, according to an embodiment of the present invention.

FIG. 27 exemplarily illustrates a flowchart 2700 for detecting and identifying the cards from the computing device/tablet display screen in the live wager-based gaming environment of the system, according to an embodiment of the present invention. At step 1702, the system identifies the frame (position from where it needs to read the card(s)). At step 1704, the system sends the pixel data inside the frame in real time to the server. At step 1706, the system also checks the pixels of the card(s) separately and matches card rank to the existing card rank pixel database (it should be the closet possible to the pixels). At step 1708, the rank is either A or 2, 3, 4, 5, 6, 7, 8, 9, 10, J, Q, K. At step 1710, the system gives a code for each of the card(s) based on their rank(s) e.g. A-, or 2- or 3-, . . . or K-. At step 1712, the system checks the color pixels (red or black) (or if possible, checks directly the sign pixels (suit) of hearts, diamonds, spades, clubs) and matches them to the color (or the sign/suit pixels in the database) for all the cards. At step 1714, the system matches the codes received to the codes of the cards in the database e.g. for the ace of hearts it will have the code ARH (ace, red, hearts) or AH (ace of hearts) and for the 2 of clubs it will have the code 2BC (two, black, clubs) or 2C (two of clubs). At step 1716, the system extracts the card(s) from the database and displays it (them) each on its respected external flexible/bendable screen or an external non-flexible/non-bendable screen.

The system extracts the card(s) from the database and displays it (them) each on its respected external flexible/bendable screen or on an external non-flexible/non-bendable screen.

At step 1718, the cut-off point is after the "no more bets" i.e. it performs the same task right after the no more bets on all the card games except the Texas Hold'em poker where the cards change whenever two new cards are dealt for the player for a new game and the cut-off for the community cards is right after a winner is announced.

Advantageously, the present invention could be installed/used inside casinos without the need for dealers or other operators i.e. the player can play on the table by him/herself and in this case, there should be an automated spin for Roulette and computerized random card generators for all the card games. The present invention could also be incorporated along with the VR and Hologram technologies to increase the remote interactivity with other players. The 3d hologram would be used to project the image of other players and dealers in live streaming video and in real-time, i.e. as if the players are sitting together on the table, but in fact they might be in another country or region. This could also be very important for Texas Hold'em Poker players who prefer to see other players' reactions, emotions and faces. Although the present invention is designed for playing on real casino table games from home designed for single player, the present invention incorporated with additional technologies may allow for multiple players to play from same region, for example, same home and on the same table device.

Although single embodiments of the invention have been illustrated in the accompanying drawings and described in the above detailed description, it will be understood that the invention is not limited to the embodiments developed herein, but is capable of numerous rearrangements, modifications, substitutions of parts and elements without departing from the spirit and scope of the invention.

Although the Roulette, Texas Hold'em Poker embodiments of the invention are detailed more than the other games (War, Caribbean Stud, Russian Poker, Pai Gown Poker . . . ), these other casino table games could employ the same technologies, systems, components and software mentioned in here and in the drawings as well as other technologies that serve the same purpose.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the details presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A system for providing a live wager-based gaming environment, comprising:

a computing device comprising one or more processors and a game display, the one or more processors being configured to receive data relating to a physical betting area and to generate a virtual representation of at least one gaming field based on the received betting area data, and to cause the virtual representation of the gaming field to be displayed on the game display;

one or more gaming devices, each gaming device comprising either a display configured to receive and represent game piece data from the computing device or, a token comprising an identification tag in communication with the computing device, each gaming device thus being configured to act as a physical representation of a corresponding virtual game piece in the gaming field; and a detector device configured to detect, identify, and determine a position of each of the one or more gaming devices within the betting area and to transmit the detected betting area data to the computing device;

wherein the one or more processors of the computing device are configured to:

receive the betting area data from the detector device;

determine, by comparing the received betting area data to previous betting area data, whether one or more of a position and state of one or more gaming devices have changed from the previous betting area data;

if one or more of a position and state of the one or more gaming devices have changed, updating the virtual representation of the gaming field to represent the change.

2. The system of claim 1, wherein the computing device is configured to receive one or more user selections including a selection for generating the at least one virtual representation of the gaming field.

3. The system of claim 1, wherein the computing device is in communication with a gaming device and an online casino and/or an online casino game, and wherein the computing device is configured to be an intermediate between the gaming device and the online casino and/or the online casino game.

4. The system of claim 1, wherein the gaming devices are configured to simulating casino table games layout comprising one or more display device and tokens and that function remotely without any operator or dealer.

5. The system of claim 4, wherein the display device is at least one of a flexible screen.

6. The system of claim 5, wherein the display device is configured to function as physical playing card(s) for displaying the card(s) generated by a computer system or drawn by an online live dealer and linked with the gaming server.

7. The system of claim 1, wherein the detected betting area data comprises position, value and number of tokens placed for wager and value of the playing card.

8. The system of claim 1, wherein the detector device is a Bluetooth low energy (BLE) beacon configured for detecting the position of the token placed on the simulated casino table.

9. The system of claim 1, wherein the detector device comprises of digital scales connected to a PCB and a computing device, the detector device reports the weight of total physical casino chips/tokens placed on each of these digital scales which is decoded by the PCB, through a machine-readable medium into computer readable value, and then transforming the data generated by these digital scales thereby said data is used by the computing device in the performance of the whole system.

10. The system of claim 1, wherein the detector device comprises a first BLE beacon configured with the wager bases of the layout table of the chosen gaming field and a second BLE beacon is configured with the wager tokens to be placed on a particular position of the layout table.

11. The system of claim 10, wherein, each first and second BLE beacons are encoded with information comprising specific codes, to be decoded and transferred to the computing device when the power is switched on and wherein the said wager tokens are positioned proximate to the detector device on the said layout table.

12. The system of claim 1, wherein the detector device is a position detecting means.

13. The system of claim 1, wherein the detector device comprises a light color sensor for detecting the position and the number of chips/tokens positioned on the layout table.

14. The system of claim 1, wherein the detector device is an ultrasonic or laser sensor having an encoded code.

15. The system of claim 14, wherein the ultrasonic or laser sensor with the encoded code is configured for measuring the distances of the positioned tokens, and reporting the measured distances to the computing device, the computing device accepting the farthest reported distance and dividing the distance by the thickness of each of the tokens and reporting the number of tokens on the wager and the code of the sensor.

16. The system of claim 1, wherein the casino table layout gaming device have LED or laser light with unique colours and unique codes in each of the betting areas on the layout and whereby the detector is inside the casino chip/token that contains a colour sensor, a BLE, a USB DART bridge and a batter, wherein the casino chip/token reports the colour of the light to the computing device.

17. The system of claim 1, wherein the detector device is a smart 3D camera, coupled to the computing device through a PCB and encoded with specific instructions.

18. The system of claim 17, wherein the 3D cameras captures images of the layout table, reports the captured images to the computing device, the computing device compares the reported images with the database of the token images and identifies the number and value of the token placed on the layout table.

19. The system of claim 18, wherein the images are captured every 0.1 seconds and reported to the system and the system updated real-time.

20. The system of claim 1, wherein tiny cameras with different codes are directed upwards and on placement of casino chips/tokens on the cameras.

21. The system of claim 20, wherein each casino chips/tokens has different colour stripes in the centre area, wherein the tiny cameras are configured to capture images on placement of the casino chips/tokens over the camera, wherein the tiny cameras are configured to capture photos directed towards the centre of the chips above them and reporting these photos to the computing system wirelessly, wherein the photos are analysed in the database to identify how many different colours are placed over which camera, wherein the cameras are identified by their codes, and wherein the system knows how many and what type of chips are placed on each of the cameras.

* * * * *